US007392555B2

(12) United States Patent
Danaher

(10) Patent No.: US 7,392,555 B2
(45) Date of Patent: Jul. 1, 2008

(54) BED-TENT

(75) Inventor: Thomas C. Danaher, New York, NY (US)

(73) Assignee: Happy Camper, Inc., New York, NY (US)

( * ) Notice: Subject to any disclaimer, the term of this patent is extended or adjusted under 35 U.S.C. 154(b) by 0 days.

(21) Appl. No.: 11/247,542

(22) Filed: Oct. 11, 2005

(65) Prior Publication Data

US 2006/0064818 A1 Mar. 30, 2006

Related U.S. Application Data

(63) Continuation-in-part of application No. 10/649,036, filed on Aug. 27, 2003, now Pat. No. 6,952,844.

(51) Int. Cl.

| | |
|---|---|
| ***A47C 29/00*** | (2006.01) |
| ***E04H 15/02*** | (2006.01) |
| ***E04H 15/40*** | (2006.01) |
| ***E04H 15/44*** | (2006.01) |

(52) U.S. Cl. ..... 5/414; 135/96; 135/125; 135/126; 135/128

(58) Field of Classification Search ..... 5/414, 5/113, 424, 658; 135/96, 156, 125–128, 135/137, 138, 143, 116, 119, 906
See application file for complete search history.

(56) References Cited

U.S. PATENT DOCUMENTS

| | | | |
|---|---|---|---|
| 1,608,242 | A | 11/1926 | Sava |
| 3,474,802 | A | 10/1969 | Loring |
| 3,665,944 | A | 5/1972 | Knapp |
| 3,800,468 | A | 4/1974 | DeGraff |
| 3,800,814 | A | 4/1974 | Hibbert |
| 3,848,615 | A | 11/1974 | Warner et al. |
| 3,929,145 | A | 12/1975 | Schroeder |
| 3,960,161 | A | 6/1976 | Norman |

(Continued)

FOREIGN PATENT DOCUMENTS

| | | |
|---|---|---|
| AU | 49503/72 | 6/1974 |

(Continued)

OTHER PUBLICATIONS

Campmor—Spring 1995, pp. 1 and 15.

(Continued)

*Primary Examiner*—Robert G Santos
(74) *Attorney, Agent, or Firm*—Reising, Ethington, Barnes, Kisselle, P.C.

(57) ABSTRACT

A bed-tent provides an enclosure over a mattress. The tent forms a canopy having panels each with a resilient, strip frame member and a sheet of flexible fabric. Retainers secure the canopy on the mattress. In some forms, a frame member disposed externally of the canopy helps to hold the panels and canopy upright. In other forms, the frame members are configured so that no additional support is needed to hold the panels and/or bed tent upright on a bed. The frame members may be readily adapted for use in curved or rectilinear panels to permit a wide range of bed tent designs and features. The frame members preferably can be twisted or wound into flat coils of reduced diameter or other form so that the entire canopy can be conveniently stored in a small package.

28 Claims, 15 Drawing Sheets

U.S. PATENT DOCUMENTS 3,970,096 A 7/1976 Nicolai
3,990,463 A 11/1976 Norman
4,569,362 A 2/1986 Fidler, Jr.
4,590,956 A 5/1986 Griesenbeck
4,682,436 A 7/1987 Ritson
4,815,784 A 3/1989 Zheng
4,825,578 A 5/1989 Robinson
4,825,892 A 5/1989 Norman
4,846,205 A 7/1989 Knoll
4,852,598 A 8/1989 Griesenbeck
4,858,634 A 8/1989 McLeese
4,945,584 A 8/1990 LaMantia
4,979,531 A 12/1990 Toor et al.
5,029,847 A 7/1991 Ross
5,031,652 A 7/1991 Lester
5,137,044 A 8/1992 Brady
5,163,461 A 11/1992 Ivanovich
5,301,705 A 4/1994 Zheng
5,343,887 A 9/1994 Danaher
5,411,046 A * 5/1995 Wan ..... 135/126
5,452,934 A 9/1995 Zheng
5,467,794 A 11/1995 Zheng
5,517,707 A 5/1996 La Mantia
5,560,385 A 10/1996 Zheng
5,579,799 A * 12/1996 Zheng ..... 135/126
5,592,961 A * 1/1997 Chin ..... 135/125
5,601,105 A 2/1997 Blen et al.
5,664,596 A 9/1997 Zheng
5,676,168 A 10/1997 Price
5,685,076 A 11/1997 Curley
5,722,446 A * 3/1998 Zheng ..... 135/125
5,778,915 A 7/1998 Zheng
5,816,279 A 10/1998 Zheng
5,845,697 A * 12/1998 Zheng ..... 160/370.21
5,941,265 A * 8/1999 Zheng ..... 135/125
5,975,101 A * 11/1999 Zheng ..... 135/125
6,006,772 A * 12/1999 Zheng ..... 135/126
6,032,685 A 3/2000 Zheng
6,073,643 A * 6/2000 Zheng ..... 135/125
6,082,386 A * 7/2000 Zheng ..... 135/126
6,092,544 A * 7/2000 Zheng ..... 135/125
6,109,282 A 8/2000 Yoon
6,138,701 A 10/2000 Zheng
6,155,281 A * 12/2000 Zheng ..... 135/126
6,209,557 B1 * 4/2001 Zheng ..... 135/126
6,220,265 B1 * 4/2001 Zheng ..... 135/125
6,220,998 B1 * 4/2001 Kellogg et al. ..... 493/218
6,267,128 B1 * 7/2001 Zheng ..... 135/126
6,267,129 B1 * 7/2001 Zheng ..... 135/126
6,269,826 B1 * 8/2001 Zheng ..... 135/126
6,289,910 B1 * 9/2001 Zheng ..... 135/125
6,305,396 B1 10/2001 Zheng
6,318,394 B1 * 11/2001 Zheng ..... 135/126
6,325,086 B1 * 12/2001 Shinner et al. ..... 135/126
6,357,510 B1 * 3/2002 Zheng ..... 160/354
6,360,761 B1 3/2002 Zheng
6,363,955 B1 4/2002 Louie
6,390,111 B2 5/2002 Zheng
6,453,923 B2 * 9/2002 Zheng ..... 135/126
6,460,556 B2 * 10/2002 Zheng ..... 135/125
RE37,924 E * 12/2002 Kellogg et al. ..... 220/9.2
6,491,052 B1 12/2002 Zheng
6,494,335 B1 * 12/2002 Kellogg et al. ..... 220/9.3
6,499,498 B1 * 12/2002 Zheng ..... 135/125
6,502,596 B1 * 1/2003 Danaher ..... 135/126
6,575,185 B2 6/2003 Zheng
6,604,537 B2 * 8/2003 Zheng ..... 135/126
6,672,323 B2 1/2004 Gupta et al.
6,684,894 B2 * 2/2004 Zheng ..... 135/126
6,694,994 B1 2/2004 Zheng
6,736,152 B2 * 5/2004 Zheng ..... 135/126
6,752,163 B2 6/2004 Zheng
6,766,815 B2 * 7/2004 Zheng ..... 135/143
6,782,905 B2 * 8/2004 Chu et al. ..... 135/143
6,848,460 B2 * 2/2005 Zheng ..... 135/126
6,851,439 B2 * 2/2005 Zheng ..... 135/126
6,901,940 B2 * 6/2005 Zheng ..... 135/126
6,926,020 B2 * 8/2005 Zheng ..... 135/126
6,948,632 B2 * 9/2005 Kellogg et al. ..... 220/9.4
6,952,844 B2 * 10/2005 Danaher ..... 5/414
7,040,333 B1 * 5/2006 Ransom et al. ..... 135/126
7,073,523 B2 * 7/2006 Zheng ..... 135/126
7,137,399 B1 * 11/2006 Ransom et al. ..... 135/128
7,140,376 B2 * 11/2006 Zheng ..... 135/128
7,159,601 B2 * 1/2007 Zheng ..... 135/126
7,174,584 B2 * 2/2007 Danaher ..... 5/414
7,306,003 B2 * 12/2007 Zheng ..... 135/126
2001/0011550 A1 * 8/2001 Zheng ..... 135/126
2005/0044630 A1 * 3/2005 Danaher ..... 5/414
2005/0121061 A1 * 6/2005 Zheng ..... 135/126
2005/0126616 A1 * 6/2005 Zheng ..... 135/126
2005/0205123 A1 * 9/2005 Zheng ..... 135/126
2005/0263175 A1 * 12/2005 Zheng ..... 135/126
2005/0274406 A1 * 12/2005 Danaher ..... 135/126
2005/0279395 A1 * 12/2005 Zheng ..... 135/126
2006/0005872 A1 * 1/2006 Zheng ..... 135/125
2006/0064818 A1 * 3/2006 Danaher ..... 5/414
2006/0076044 A1 * 4/2006 Zheng ..... 135/126
2006/0249191 A1 * 11/2006 Zheng ..... 135/126
2006/0289047 A1 * 12/2006 Zheng ..... 135/126
2007/0039640 A1 * 2/2007 Zheng ..... 135/126
2007/0062570 A1 * 3/2007 Zheng ..... 135/126
2007/0119491 A1 * 5/2007 Zheng ..... 135/126
2007/0119492 A1 * 5/2007 Zheng ..... 135/126
2008/0026880 A1 * 1/2008 Zheng ..... 473/479

FOREIGN PATENT DOCUMENTS

FR 2640669 6/1990

OTHER PUBLICATIONS

Quickdraw—Quickdraw Pop up Style Self Erecting Tents, pp. 2-5.

* cited by examiner

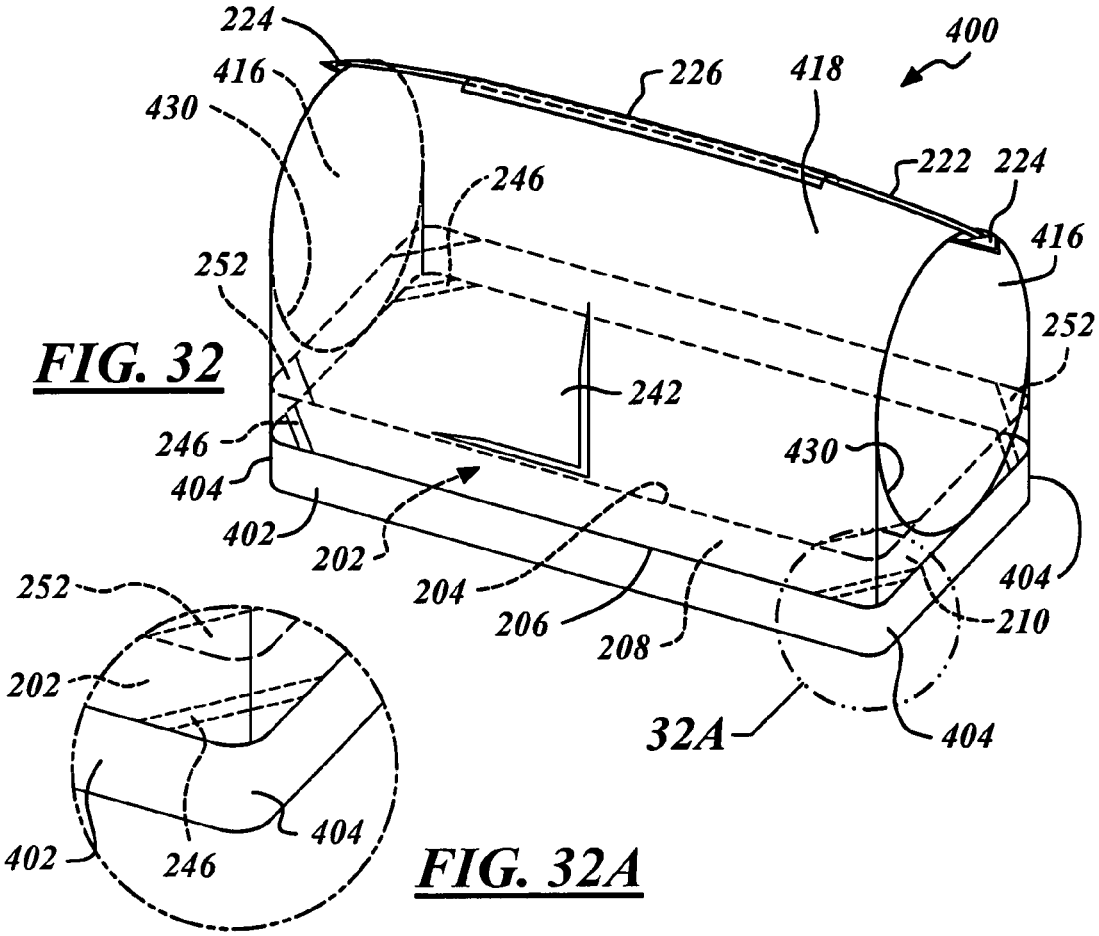
FIG. 32
FIG. 32A
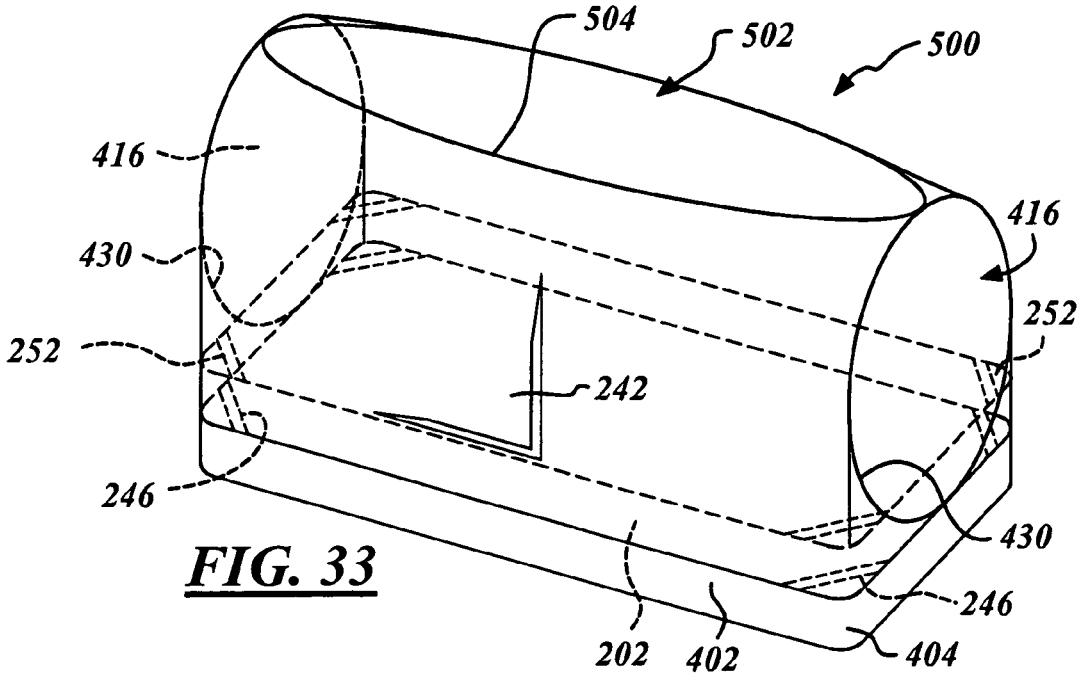
FIG. 33

BED-TENT

REFERENCE TO RELATED, CO-PENDING APPLICATION

This application is a continuation-in-part of U.S. patent application Ser. No. 10/649,036, filed on Aug. 27, 2003 now U.S. Pat. No. 6,952,844.

TECHNICAL FIELD

Portable tents are well-known and can be used for many different purposes. This invention relates to tents adaptable for indoor use. More particularly, the tent of this invention incorporates a bottom portion adapted to be fitted over a conventional mattress. Known in the prior art as a Bed-tent, this embodiment is especially popular for use as a children's toy.

BACKGROUND AND SUMMARY

Prior art Bed-tents consist of some sort of a fabric covered pole structure, which rests on the top surface of a conventional bed mattress. Prior art Bed-tents utilize semi-rigid, bowed poles which place the cover or canopy under tension; the tension is provided by bending the support poles and securing them with a canopy which is attached to the mattress. Bed-tents have enjoyed commercial success but have always presented problems of various types.

One of the principal problems with prior art Bed-tents is that associated with erecting them. Prior art Bed-tents require simultaneous assembly of an independent pole structure and a separate canopy, and the user must be familiar with an exacting set-up procedure. The process begins with unpacking a bewildering assortment of pole segments and an enormous, shapeless canopy. Segments of different-length poles are connected and passed through a specific sequence of fabric sleeves or the like; the sleeves and canopy form a confusing labyrinth and choosing the correct pole for the correct sleeve makes this an unforgiving process. Each pole is then secured at both ends by insertion into a flexible pocket affixed to the canopy; the user must combat the tension of each pole during this process which becomes more difficult as more poles are added. Further, the finished set-up shape is completely unrecognizable when the structure's components are laid out; only after the final pole is secured does the Bed-tent's shape become apparent. It is no surprise that the instruction manuals for prior-art Bed-tents caution, "Adult assembly required."

Further complicating the set-up procedure, all prior-art Bed-tents place the flexible frame members inside the canopy, where access is limited during set-up and assembly. Original Bed-tent U.S. Pat. No. 4,852,598 describes, "elongated flexible frame members adapted to support said canopy means over said mattress when positioned between said top surface of said mattress and said canopy means." Erecting such Bed-tents requires adults to climb inside the partially supported, trembling canopy while securing the internal pole structure in an exact position. As most adults cannot fit inside prior-art Bed-tents, which are designed to attach to a child's twin size mattress, the torments above are greatly multiplied.

Ease of set-up is a strong consideration for adults purchasing toys such as a Bed-tent. In short, parents generally will not tolerate time-consuming assembly of toy products and frequently return a product to the retailer if assembly is too difficult. Present day Bed-tents suffer the significant liability of an extra-ordinarily high return percentage. Most Bed-tents are currently sold through mail-order outlets, which offer generous return privileges; traditional retailers no longer distribute the prior art product.

Attempts have been made to simplify the task of erecting the Bed-tent. U.S. Pat. No. 4,590,956 proved too difficult to assemble because of an integrated canopy and fitted sheet which attached to the mattress. U.S. Pat. No. 4,852,598 eliminated the integral fitted sheet and thus simplified the set-up procedure but only to a small degree.

A Bed-tent is disclosed herein which eliminates the internal frame assembly of the prior art. This Bed-tent instead utilizes a flexible, resilient strip material induced by a non-stretch fabric to form a weight-bearing panel. By itself the strip sags and offers no support, however because the strip is secured at generally all points of it's perimeter by the attached non-stretch fabric, it can bear considerable weight. The weight-bearing capacity of the resilient strip is increased by the provision of anchoring means or retainers, such as elastic bands, which releasably attach the structure to the mattress.

The strip material may be made of plastic, metal, fiber composite or the like and is collapsed by turning or twisting into a packed generally flat disk as illustrated. The strip may be a closed annulus and with the covering fabric forms a panel that is circular, oval, elliptical or generally square, rectangular or triangular with acute or truncated corners. It should be noted that different-shaped panels can be used interchangeably. The strip may also be open-ended rather than a closed annulus to form an arch-type panel; the strip(s) may be permanently or removably attached to the fabric cover to allow washing of the fabric. It may also include a coupling means that permits the abutting ends of the strip material to rotate with respect to each other to simplify the collapsing process. The panel incorporates openings for doors and/or windows and retains the weight-bearing feature.

One presently preferred embodiment of a Bed-tent is comprised of two opposing panels, a releasably connected pole to maintain them generally upright and a flexible fabric canopy, which forms an enclosure. The pole is segmented for folding and made of plastic, fiberglass or the like and may be adapted, as a non-limiting example, by forming an upside-down "V" for increased headroom inside the structure. The pole can be placed inside or outside of the canopy; the preferred embodiment utilizes an external pole to provide full accessibility while assembling and disassembling the structure. The resilient strip of the preferred embodiment may be substituted by semi-rigid members made of fiberglass, plastic or the like and made of segmented pieces and connected by an elastic cord, or telescoped, for ease of storage. Semi-rigid frame members may be utilized in the manner as prior bed-tent U.S. Pat. No. 4,852,598; however positioned outside the canopy for ease of assembly.

Similar to the preferred embodiment, a related arrangement is comprised of three panels (rather than two) and a canopy, which forms an enclosure. The additional panel is arranged along the third side of the structure; the pole, while not required, preferably supports the canopy and a fourth side of the structure. The three panels may also be arranged as two opposite sides and roof, in which case the pole may be eliminated, but this structure may be less stable.

A further related arrangement incorporates four panels and a fabric canopy to form an enclosure. As above, three panels are arranged along the sides of the structure. The additional panel supports the roof; the pole may be eliminated without loss of stability. One panel may also be arranged on each of the four sides of the structure and, as in the previous arrangement, the pole may be eliminated. However, in this arrangement at least one pole—or pole assemblies—may be releasably attached between the panels to provide for vestibules, awnings, wings, fins or other aesthetic and/or semi-functional adaptions. This latter arrangement may also accommodate a fifth panel to support the roof. Some embodiments with more than two panels may be easier to set-up and disassemble by the provision of at least one releasable coupling on one or more of the panels.

The panels can be adapted to provide increased stability. For example, panels suffer from buckling or bowing along the length of the mattress or when wider mattresses are contemplated; larger panels are also difficult to collapse. To increase the stability of the structure and to simplify the collapsing process, both the resilient strip and covering fabric of the panels may be adapted in several ways. Two strips, which overlie each other on a portion thereof in the same panel, provide more support than a single residual strip and collapse as usual. A panel utilizing a resilient strip formed in a "figure 8" arrangement (which is essentially two smaller panels) increases stability and collapses as usual. The "figure 8" arrangement can turn the corner of the mattress and thereby form at least a portion of two sides of the structure. Similarly, a larger panel may be comprised of two or more smaller panels in the same plane; the smaller panels can be adjoined or spaced apart and connected by an interconnecting piece of fabric, which is part of the panel. Adjoining panels may also be overlapped by a further panel secured to them by Velcro®, buttons, snap-fit engagements or ties as common in the art. Maximum stability is gained by overlapped panels secured by stitching or the like. In such an arrangement, one panel "pierces" the fabric covering of another panel and is stitched at the intersection point to the pierced panel. The overlapped panels pivot around the intersection point; when pivoted in one direction, the panels lie atop each other and collapse as usual. When pivoted in the opposite direction, the overlapped section of the panels prevents them from moving beyond an in-line configuration with each other. Two overlapped, intersecting panels in the same plane form a very stable equivalent of one larger panel. Similarly, two overlapped, intersecting panels in perpendicular planes form a very stable right-angle configuration for the corners of a structure. Elastic bands, attached to the outside distal section of the panels, maintain the overlapped panels in a right-angle configuration when stretched over the corners of the mattress.

An even simpler arrangement utilizes only a single resilient strip to form the frame of the structure, however it is the least stable of the embodiments. The single strip is induced by the fabric into a saddle-shaped annulus comprised of four serially-connected arches; each arch forms one side of a rectangle which corresponds generally to the shape of a bed mattress. The first arch is upwardly-shaped along the length of the mattress, the second arch is shaped downwardly as it traverses the mattress end, the third arch is again upwardly-shaped along the length of the opposite side of the mattress, the fourth arch is downwardly-shaped and traverses the opposite end of the mattress. A similar arrangement turns the saddle-shaped annulus upside down. Embodiments illustrated in the following figures include a resilient strip which crosses at the apex of the annulus in the formation of a "figure 8" with the arches of the "8" extending downwards to form the sides of the structure.

Bending or pre-forming the resilient strip of these embodiments contributes significant advantages. Strip members shaped at the four corners conform to the rectangular shape of the mattress instead of assuming a circular or oval shape which expands over the edges of the bed. The shaping also increases the internal "living space" of the structure. Similarly, bending the upward strip so it is approximately flat instead of arched raises the structure's height and increases "headroom" for the user. To facilitate bending of the resilient strip material, rounded stock (rather than flat stock) of plastic, metal, fiber composite or the like is preferred but not required. Rounded stock "takes" a bend in any direction more readily than flat stock which bends easily in one plane but not in the other.

Instead of a single strip, the structure of my invention may utilize two or more resilient strips for enhanced stability. Certain embodiments may include a second or third strip inside the same or separate fabric channels. The strips may be made from a continuous piece of strip material or from separate strips. Multiple strip embodiments also allow for frames made of different material and diameters; for example in one embodiment, the member forming the base of the Bed-tent is made of a lighter, reduced diameter, less-expensive stock than the upward-shaped member. Rotatable connectors between the ends of the strip material eases the folding of the structure and allows embodiments with base strip members to lay flat after assembly. The rotatable connector(s) may be designed to couple the separate strip members although such coupling is not required.

Another embodiment of the present invention utilizes a single continuous resilient strip, which forms the base of the structure. The fabric canopy is supported by one or more open-ended resilient strips formed into an arch shape by a fabric channel affixed to the base by stitching or the like. A pivoting junction, affixed to the base loop is a further non-limiting attachment means. To assemble the structure, the open-ended resilient strips are raised generally vertically and attached to the canopy by ties, tabs, Velcro® or the like. To collapse the structure, at least one open-ended resilient strip is detached from the canopy, allowing both open-ended strips to lie atop of the resilient base strip. The structure is collapsed by folding as usual. Both the base strip and the open-ended strip(s) can be bent, as previously described, to better conform to the rectangular shape of the mattress.

To assemble the bed-tent, the resilient strip pops open and virtually "self-erects" when shaken by the user. The segmented pole, when required, is unfolded and inserted into a flexible fabric sleeve or flexible pole-pockets attached to the canopy. Placing the structure on top of the bedding, the user fits elastic band retainers or the like, attached to the four corners of the bed-tent, over the four corners of the mattress. Elastic bands readily adapt to the user's bedding and to mattresses of varying thicknesses, whether 8 or 18 inches or any size. A similar means incorporates fabric pockets stitched to the ends of the structure. Both arrangements allow the bed-tent to be attached on top of bedding such as sheets and blankets. A third arrangement, attaches the structure to a conventional fitted sheet, but the user's bedding is partially or fully covered thereby. While the bed-tent of my invention is preferably attached to the top of a mattress, it can be adapted for a lower position on the bed: elastic bands or fabric sections, fitted between the mattress and box spring, or on top of the top mattress, or both, affix the bed-tent to the peripheral sides of the mattress and prevent the structure from sliding to the floor. This arrangement allows for bedding to be "tucked in" in the normal manner and otherwise includes all the features and forms disclosed previously.

To disassemble the bed-tent, the user detaches the elastic bands or the like from the mattress. When a segmented pole is used, it is detached from the structure and folded. If overlapped panels are used, they are manipulated to lie upon each other. The panels are collapsed as illustrated.

Accordingly, several advantages and benefits of the present invention are described hereinafter.

Base of Assembly

The bed-tents are uniquely easy to assemble. When shaken by the user, the collapsed panels pop open and virtually self-erect; the structure's finished set-up shape is immediately recognizable. The structure is attached to the mattress by elastic bands or the like in a manner common to the bedding industry. The bed-tents can be easily assembled by a novice or first-time user; there is no "adult assembly required." Children six years old can assemble their own bed-tents without adult assistance and feel a sense of accomplishment. To disassemble the bed-tent, the assembly process is reversed and the resilient strip(s) collapsed by folding or winding as described in the accompanying drawings.

Adaptable Design

The bed-tents permit a wide range of shapes by providing for increased adaptability of the structure's framing members. Some embodiments of the bed-tents utilize a segmented pole located outside the bed-tent canopy. Because the pole is accessible, users can conveniently and with minimal expense attach additional frame members for aesthetic or semi-functional purposes conveniently and with minimal expense. For example, frame members can be added to support extensions of the canopy such as awnings, verandas, vestibules or covered windows. Elements such as wings, fins or the like can be added to increase aesthetic options. The toy industry's commercial viability depends upon new shapes and designs which the bed-tent richly provides; this is a significant advantage in the crowded, competitive field of children's toys. Finally, the bed-tents can easily be adapted for larger mattresses by increasing the size or number of the panel(s) and enlarging the canopy.

Fewer Parts

Prior art bed-tent structures required as many as seven separate rods or at least two framing assemblies. One presently preferred embodiment of a bed-tent utilizes one pole, with segments interconnected via elastic shock cord or telescoped as is customary in the art. Other embodiments eliminate the pole and instead utilize additional flexible panels as described above. In addition to using fewer parts, some embodiments of the bed-tents eliminate the possibility of lost parts.

Speedier Assembly

Still another improvement in the bed-tents is the speed of assembly. In the preferred embodiment, poles rapidly self-assemble by means of an integrated, tensioned cord. The panels pop open instantly. The structure quickly attaches to the mattress with a few elastic bands. Other bed-tent embodiments, without the pole, require only to be popped open before attachment to the mattress. Adults and especially children will appreciate the increased speed in erecting their bed-tents.

Safety

A still further improvement of my bed-tent is safety and reliability. Prior art bed-tents, which secured the poles inside the canopy with fabric ties and the like, posed a potential hazard of the child's strangulation on the framing members. The pole of my invention is located out of harm's reach outside of the canopy. Embodiments utilizing a pole bend readily and can flatten all the way to the mattress and recover to their original position. The flexible strip(s) bend to absorb stress from any direction without breakage. Access from inside the bed-tent to the elastic straps which attach the structure to the mattress, is prohibited. Further, the bed-tents are devoid of small loose parts that can be mistakenly swallowed by a child.

My bed-tent's structure and attachment means remain secured to the mattress despite considerable lateral force applied against them. A surprising and unexpected result is that at least some embodiments of the bed-tents can actually catch and hold a small child who might otherwise fall to the floor. A larger child's fall is slowed and possible impact lessened. While especially effective when closed, a partially opened bed-tent can also perform this important function.

Child Friendly Shape

The bed-tents preferably rest on an approximately rectangular, open base attached to the mattress. The open base and attachment means enable the bed-tent to fit over a child's favorite bedding; no specialized sheets, blankets, etc., are required. Further, removal of sheets or blankets is not necessary for assembly or disassembly of the structure. Bedding, including fitted sheets beneath the structure, can be neatened in the normal manner. The vertical sidewalls of my invention provide for full utilization of the mattress so pillows, blankets and toys may be pushed all the way to the edge. Finally, the bed-tents desirably can provide a consistent height throughout the entire length of the bed-tent for maximum use of the internal space.

Less Expensive

Nature's most efficient shape (maximum internal volume with minimum surface area) is a sphere. Due to the circular, elliptical or arch shape of certain portions of some embodiments of my bed-tents, they may enclose more cubic living space per given amount of fabric than any prior-art bed-tent. Putting this another way, to provide a structure of given internal size, the bed-tent of my invention requires less fabric. The consistent height of my preferred embodiment also eliminates fabric waste as full widths of material can be utilized. Because my invention eliminates the apex common to all prior-art bed-tents, costly workmanship to cut and sew irregular fabric patterns is minimized. Finally, the bed-tents eliminate the obvious disadvantage of breakage suffered by prior art bed-tents, which are ruined if a single frame member fails. Present-day bed-tent manufacturers employ costly service departments, which serve primarily to replace broken frame members.

Compact and Portable

The bed-tents preferably fold into a compact flat disc. Weight of the packed bed-tent is evenly balanced for ease of transport. The segmented pole is folded into a small bundle as common in the prior art. Containerizing, shipping and insurance costs are correspondingly reduced.

The features, advantages and objects of my invention, which are explicit and implicit in the foregoing, as well as others, will become apparent and more fully understood from the following description of the invention made in connection with the accompanying drawings.

BRIEF DESCRIPTION OF THE DRAWINGS

These and other objects, features and advantages of the present invention will be apparent from the following detailed description of the preferred embodiments and best mode, appended claims and accompanying drawings in which:

FIG. 32 is a perspective view of another implementation of a bed-tent wherein the end panels and side panels extend below the top surface of a mattress;

FIG. 33 is a perspective view of another implementation of a bed-tent including a pair of side panels and a roof panel supported by coilable hoops;

DETAILED DESCRIPTION OF PREFERRED EMBODIMENTS

Figure 1:
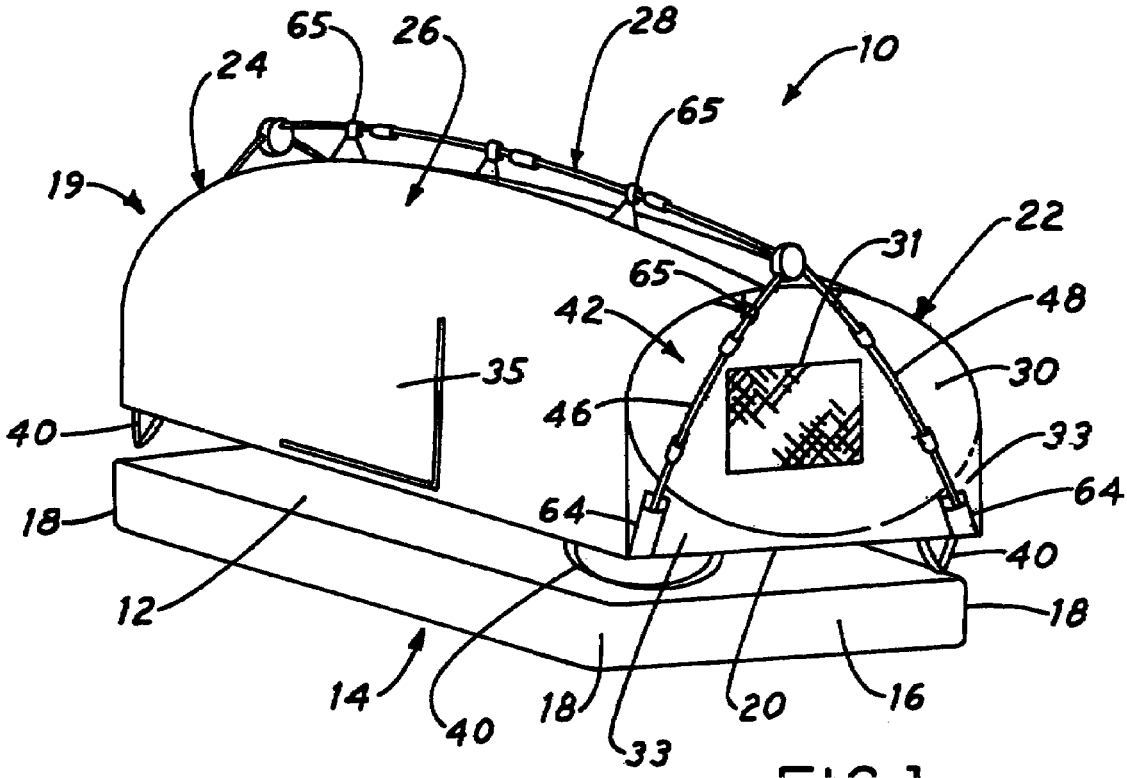
FIG. 1 is a perspective view of a bed-tent including a canopy and a supporting frame, constructed in accordance with the invention and shown positioned over a mattress in preparation for mounting the bed-tent on the mattress.
Figure 2:
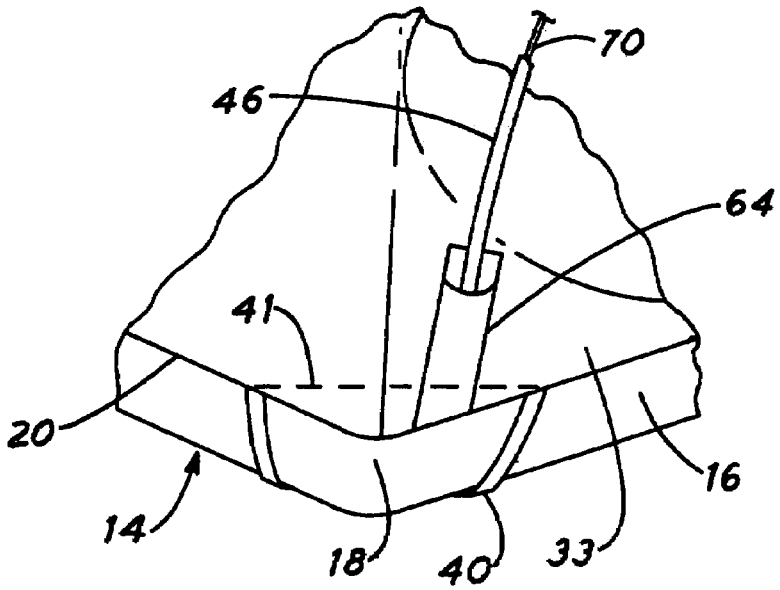
FIG. 2 is an enlarged perspective view showing a corner of the canopy attached to the mattress.
Figure 3:
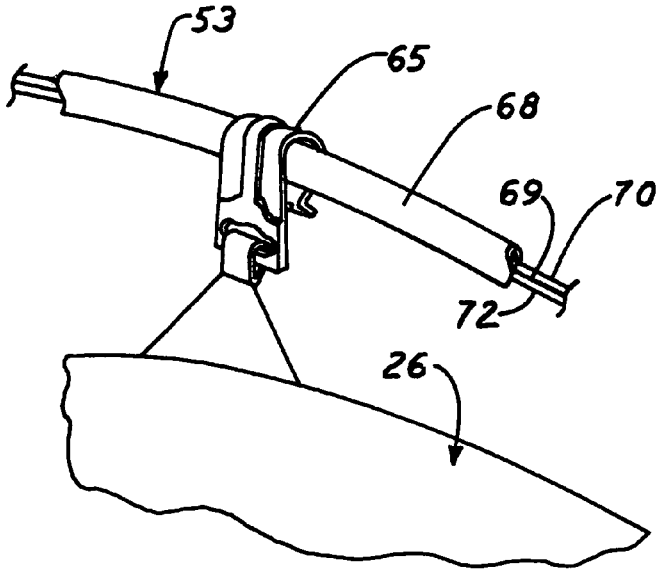
FIG. 3 is an enlarged fragmentary perspective view of a portion of FIG. 1 showing clips attaching the canopy to a portion of the supporting frame.

Referring now more particularly to the drawings, and especially FIGS. 1 and 2, there is shown a bed-tent 10 for sheltering at least one person. The bed-tent 10 is shown disposed over the top surface 12 of a mattress 14 of a bed, prior to being mounted thereon. The mattress 14 is preferably of the usual rectangular shape, having a peripheral edge 16 and four corners 18. The bed-tent 10 is intended to be occupied by one child, although more than one child may occupy the bed-tent if desired and if permitted by a supervising adult.

The bed-tent 10 comprises a canopy 19 having an open base 20 generally co-extensive with the peripheral edge 16 of the mattress. The canopy has end panels 22 and 24, and a flexible fabric cover 26. A supporting frame 28 holds the end panels in longitudinally spaced, generally upright position.

Figure 4:
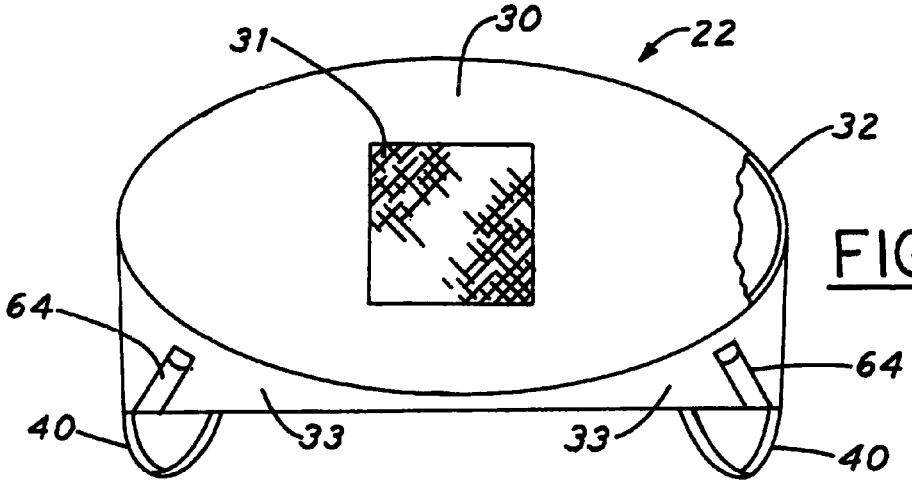
FIG. 4 is an end view of the canopy, showing one end panel thereof in which parts are broken away. The end panel at the opposite end of the canopy is exactly like to end panel shown.
Figure 5:
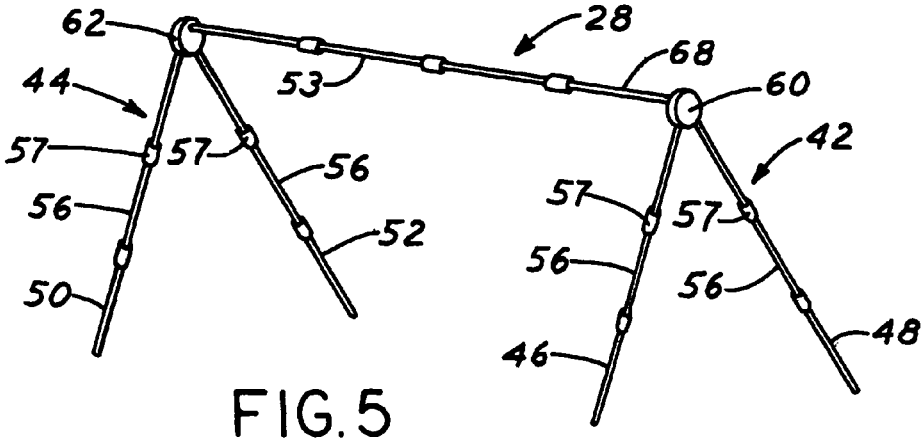
FIG. 5 is a perspective view of the supporting frame.
Figure 6:
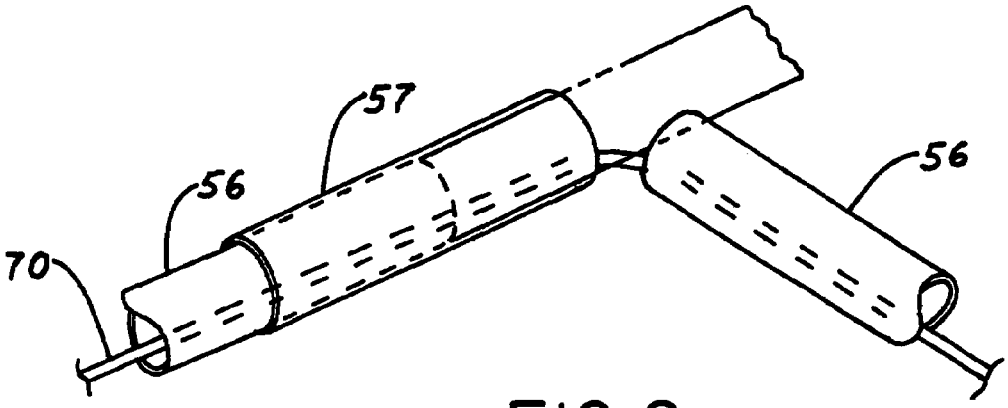
FIG. 6 is a fragmentary perspective view showing two segments of a leg of the supporting frame separated from one another.
Figure 7:
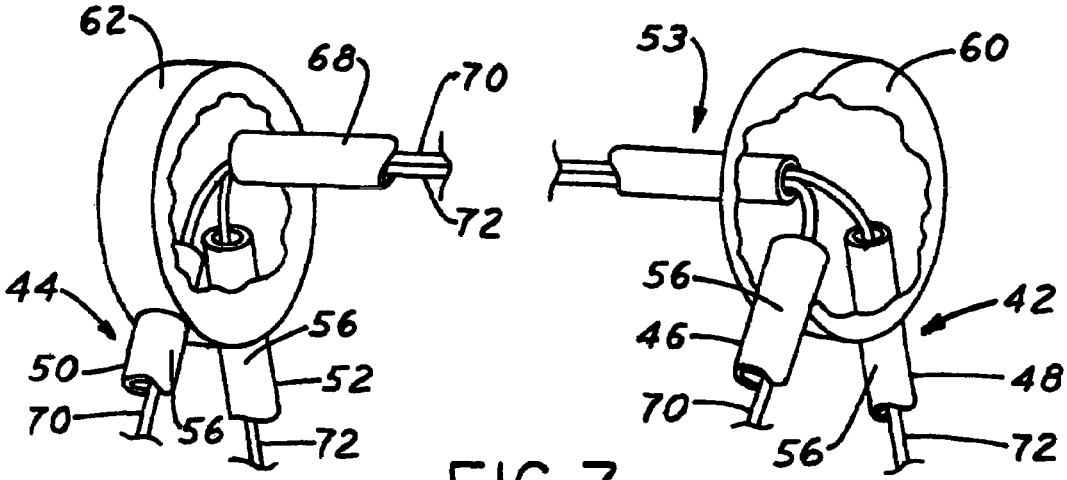
FIG. 7 is a fragmentary perspective view of portions of the supporting frame.

The end panels 22 and 24 are preferably of identical construction, each comprising a sheet 30 of substantially non-stretchable flexible fabric and a framing member in the form of hoop 32 of flexible, resilient strip material such as spring steel, composite rod or plastic, for example. Each hoop may be a continuous annulus or it may be transversely split with abutting ends at the split or open-ended to provide for an arch shape hoop (not shown). The hoops may be circular throughout a full 360° or they may be other than circular as by being of oval shape as shown in FIG. 4. Not shown are further shapes including circles or ovals incorporating one square corner, two square corners (a continuous arch annulus), triangular, approximately square or rectangular; the corners of these versions may be curved or acute. The hoops of each end panel preferably are disposed in the plane of the sheet 30 and are secured to the outer edge of the sheet, as by folding the outer edge over the hoop and stitching the folded-over outer edge to the sheet. For additional strength a second hoop of strip material (not shown) can be secured to the outer edge of the sheet. The first and second hoops can be formed of a single unitary piece of strip material. Finally, this second hoop can be adapted to be secured to the first hoop along a limited periphery thereof (not shown). The portion of the sheets 30 within each hoop 32 is held taut by the hoop and resists distortion or collapse of the hoop. A screened window opening 31 is provided in the sheet 30 of at least one end panel.

The cover 26 is made of substantially non-stretchable, flexible fabric and extends between the end panels 22 and 24. The cover 26 is held fairly taut by having its ends stitched or otherwise secured to the margins of the end panels as by a zipper, for example and to the side edges of extensions 33 of the sheets 30. The cover 26 defines the sides and top of the canopy. One side of the cover 26 has a cut away portion providing a flap 35 that may be folded back to form an opening for access to the interior of the canopy. The flap serves as a closure for the opening when extended across the opening and held shut by a zipper or other fastening device.

Two flexible retainers, preferably in the form of elastic straps 40 are secured to extensions 33 of the sheet 30 of each end panel 22, 24. The straps 40 are adapted to be extended over the four corners of the mattress 14 to hold the tent on the mattress. The four corners of the bed-tent preferably have pads or triangular fabric pieces 41 stitched or otherwise secured to the lower edges of the sides of the cover 26 and the sheet extensions 33. The pads 41 may be formed of the same fabric as the cover 26 and sheet extensions 33. Alternatively, the pads may be non-stretchable flexible strips. The pads rest upon the top surface of the mattress 14 and prevent the sides of the cover and the sheet extensions from being pulled over the peripheral edge of the mattress by the straps 40. If the bed-tent 10 has an open base 20 smaller than the mattress 14, the pads 41 may be eliminated and the elastic straps 40 lengthened.

The frame 28 includes a stanchion 42 disposed externally of the canopy 19 adjacent the end panel 22, and a stanchion 44 externally of the canopy adjacent the end panel 24. The stanchion 42 includes a first pair of legs 46 and 48. The stanchion 44 includes a second pair of legs 50 and 52. The frame 28 also includes a horizontal frame member 53 that extends between and is secured to the stanchions 42 and 44 and holds the stanchions erect.

Each of the legs 46, 48, 50 and 52 has a plurality of elongated, tubular leg segments 56 removably connected together end-to-end in a linear series. The connecting of the leg segments is accomplished by a sleeve 57 on one leg segment slidably receiving an end of an adjacent leg segment. The uppermost leg segment of each of the legs 46 and 48 of the stanchion 42 is removably fitted into a hole in a hollow coupling 60. The uppermost leg segment of each of the legs 50 and 52 of the stanchion 44 is removably fitted into a hole in a hollow coupling 62.

Pockets 64 are secured to the extensions 33 of the sheet 30 of each end panel 22, 24 to receive the lower ends of the legs 46, 48, 50 and 52 as more fully described hereinafter.

Clips 65 are attached to the outer surface of the sheets 30 of each end panel 22, 24 and to the top of the cover 26 for removable connection to the legs 46, 48, 50 and 52 and to the frame member 53.

The frame member 53 comprises a plurality of elongated, tubular frame member segments 68 removably connected together end-to-end in a linear series in the same manner as the leg segments 56. The segments 68 at the ends of the frame member 53 are removably fitted in holes in the respective couplings 60 and 62.

Elastic cording 69 secures the segments of the legs 46-52 and of the frame member 53 together under tension. The cording includes an elastic cord 70 which has one end attached to the lowermost tubular leg segment of the leg 46 and extends through all of the leg segments 56 of leg 46, through the hollow coupling 60, through the tubular segments 68 of the frame member 53, through the hollow coupling 62, and through the tubular leg segments 56 of the leg 50, being attached at the opposite end to the lowermost leg segment of the leg 50. The cording 69 also includes an elastic cord 72 which has one end attached to the lowermost tubular leg segment of the leg 48 and extends through all of the leg segments of the leg 48, through the hollow coupling 60, through the tubular segments 68 of the frame member 53, through the hollow coupling 62, and through the tubular segments of the leg 52, being attached at the opposite end to the lowermost leg segment of the leg 52.

The elastic cords 70 and 72 hold together under tension the segments of all of the legs 46, 48, 50 and 52, as well as the segments of the frame member 53.

The bed-tent is easily erected over the top surface of the mattress 14. This is accomplished by stretching and extending the straps 40 over the four corners of the mattress, inserting the lower ends of the legs 46, 48 of the stanchion 42 at one end of the canopy into the pockets 64 provided in the extensions 33 of the sheet 30 of the end panel 22, and inserting the lower ends of the legs 50, 52 of the stanchion 44 at the opposite end of the canopy into the pockets 64 provided in the extensions of the sheet 30 of the end panel 24, with the frame member 53 extending between the upper ends of the stanchions to hold them erect. An important feature of the invention resides in the fact that the entire frame 28, including the stanchions 40 and 42 and the interconnecting frame members 53 are disposed externally of the canopy. This makes it very easy to assemble the tent as it does not require the assembler to get inside the canopy.

The clips 65 on sheets 30 of the two end panels and on the cover 26 are snapped on the legs 46, 48, 50 and 52 and are snapped on the frame member 53 to provide a firm support for the canopy. Other conventional attachment means such as buttons, hooks, Velcro®, snap-fit engagements and ties may also be used.

Figure 11:
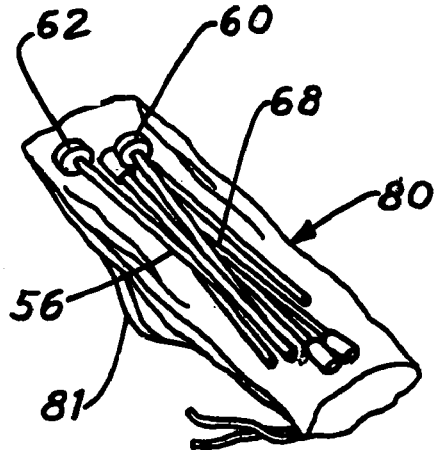
FIG. 11 is a perspective view showing the supporting frame in which the segments thereof are separated and folded and fitted into a transparent package.

The tent is just as easily taken off the mattress and stored. This is done by first unclipping the frame 28 from the canopy 19. The segments of each leg 46, 48, 50 and 52 and of the frame member 53 are separated by pulling them apart against the tension of the cords 70 and 72. The upper segments of the legs and the end segments of the frame member 53 are also separated from the couplings 60 and 62 in the same manner. All of the segments 56 and 68 are then folded together parallel to one another for storage in a package 80, for example. The package 80 is transparent and has handles 81 to provide a convenient carrying case. See FIG. 11. The separated and folded segments, of course, remain held together by the elastic cords 70 and 72.

Figure 8:
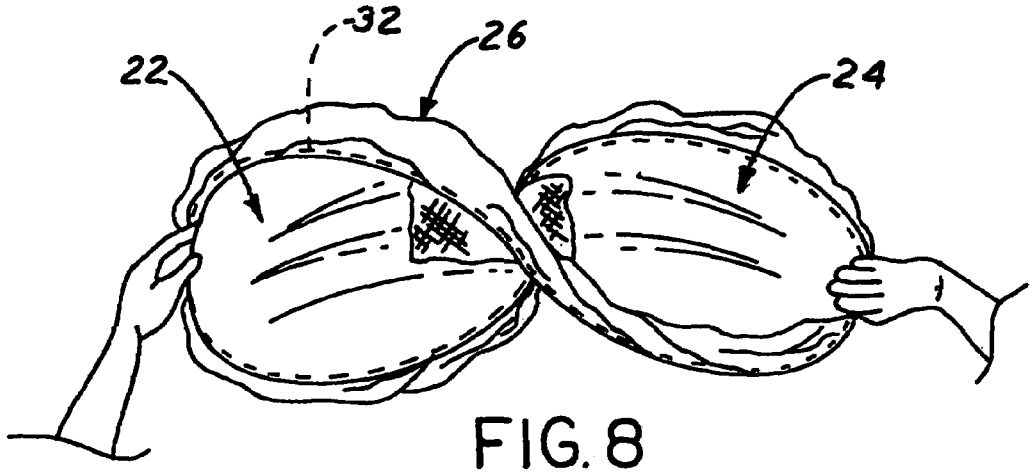
FIG. 8 is an end view showing the canopy in the process of being folded for storage.
Figure 9:
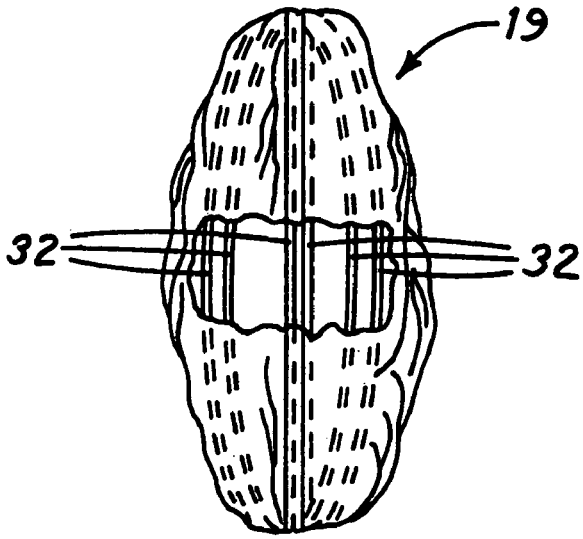
FIG. 9 is an end view showing the canopy completely folded and ready for storage.
Figure 10:
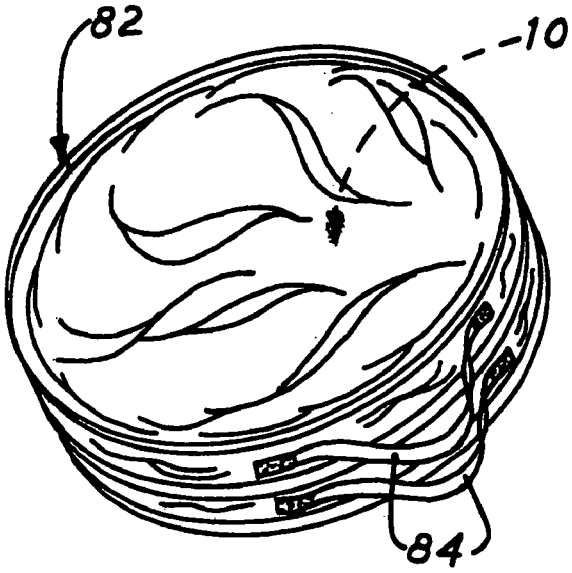
FIG. 10 is a perspective view showing the canopy folded and disposed within a transparent package.

The canopy 19 is collapsed and the hoops 32 of the end panels 22 and 24 are laid over one another and twisted (FIG. 8) or wound into a substantially flat coil of reduced diameter so that the entire canopy will fit nicely into a very small package 82 (FIG. 10) for storage. The package 82 has handles 84 and is transparent and provides a convenient carrying case.

Figure 12:
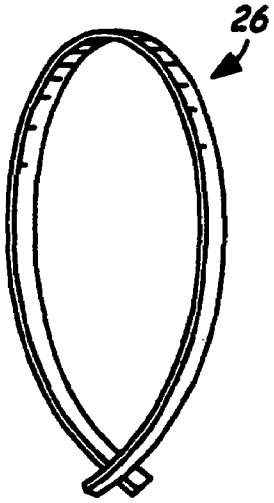
FIG. 12 is a perspective view of a transversely split hoop shown as it is initially being twisted for storage.
Figure 13:
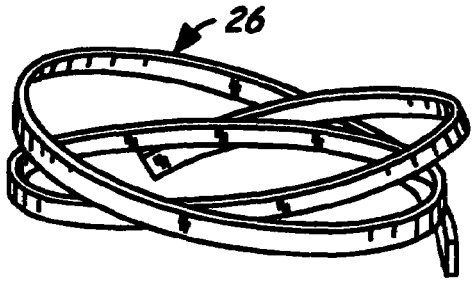
FIG. 13 is a perspective view of the hoop of FIG. 12 shown fully twisted for storage.
Figure 14:
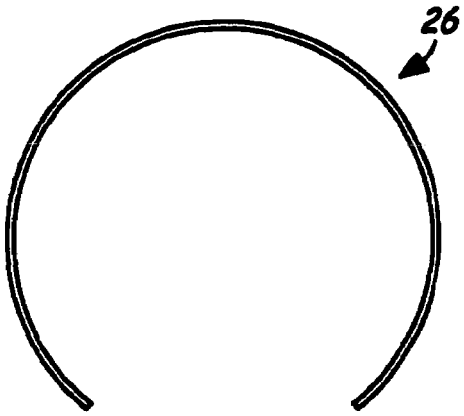
FIGS. 14-17 show a hoop in a sequence of steps by which it is wound into a flat coil of reduced diameter for storage.
Figure 15:
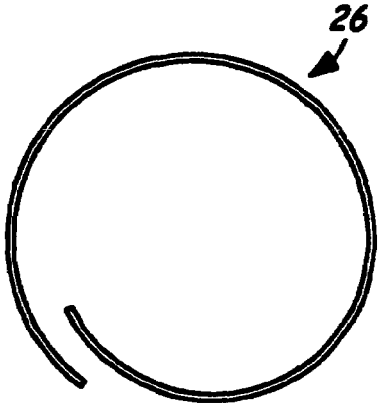
Figure 16:
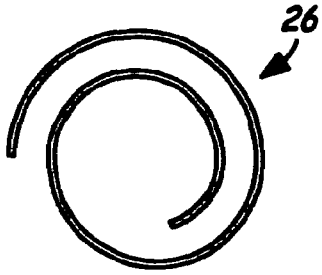
Figure 17:
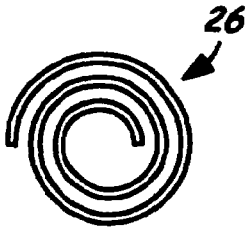

If the hoops 32 of the end panels are transversely split rather than continuous, they may be removed from the fabric through an opening provided in the stitching around the margin of the sheet material in which the hoops are received. If the hoops are not removed from the fabric stitching, the end panels will fold in a similar manner even with the hoops in place. If the hoop is open-ended to form an open arch shape panel, the ends of the hoop are first placed together before the hoop is twisted in the usual manner. FIGS. 12 and 13 illustrate how a split hoop may be twisted for storage.

FIGS. 14-17 show an alternative method of winding a split hoop for storage. Thus, the hoop may be wound into a tight spiral in a common plane to reduce its overall diameter several times for more convenient storage. Reducing a hoop to a flat coil by winding in this manner would be difficult without at least partially removing the hoop from the fabric to which it is normally attached.

Figure 18:
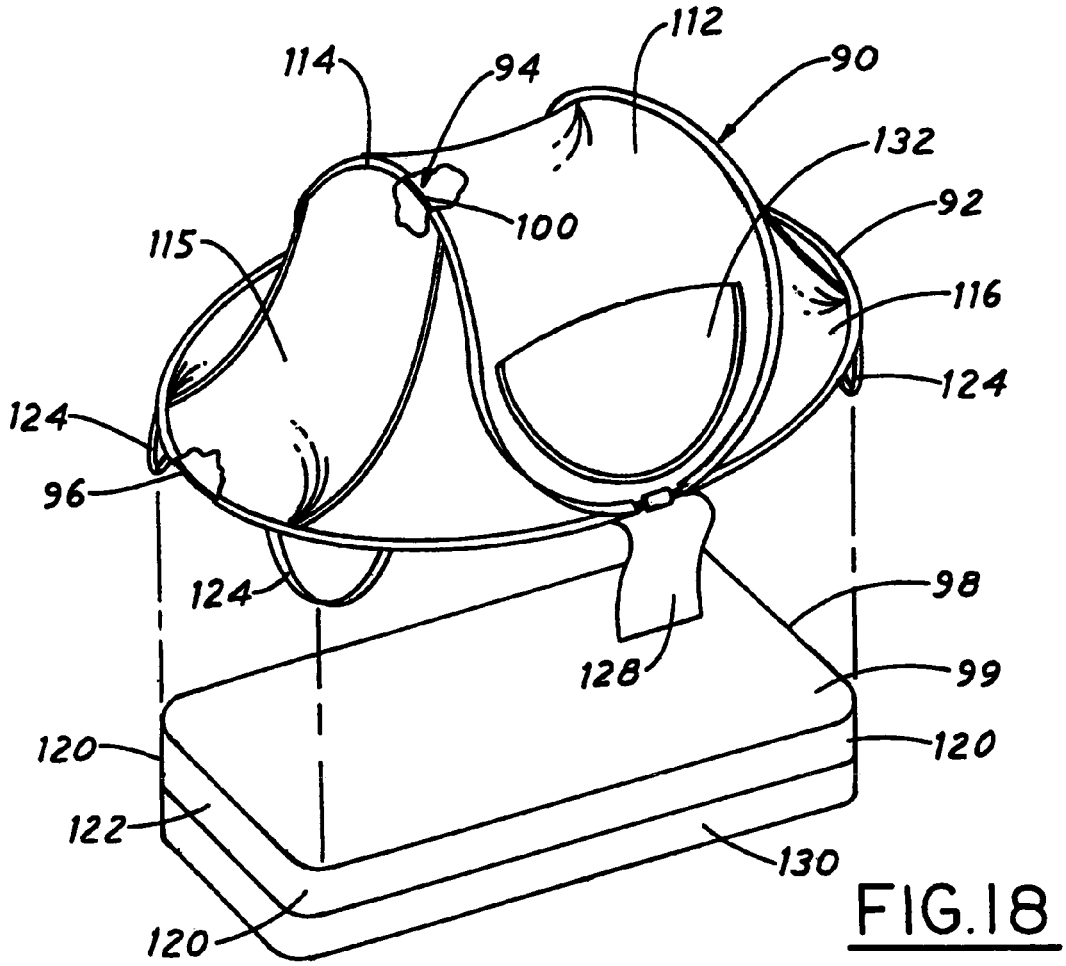
FIG. 18 is a perspective view of a bed-tent of modified construction, also according to the invention, shown positioned over a mattress prior to being mounted thereon.
Figure 19:
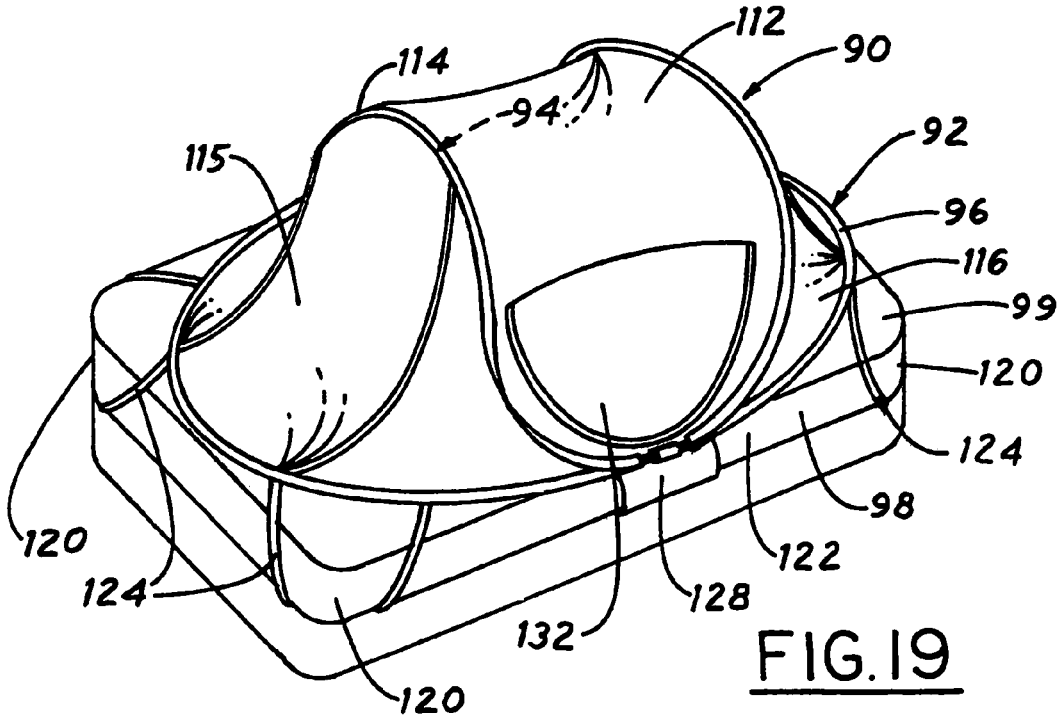
FIG. 19 is a perspective view of the bed-tent of FIG. 18 shown attached to the mattress.

FIGS. 18 and 19 are perspective views of a bed-tent 90 of modified construction. The bed-tent 90 has a base frame 92 and an upwardly arched canopy frame 94. The base frame 92 is preferably a hoop 96 of oval shape made of the same material as the hoops previously described and adapted to rest flat in a horizontal position on the top surface 99 of a rectangular mattress 98. The upwardly arched canopy frame 94 is preferably also a hoop 100 of oval shape but bent from a naturally flat condition to the upwardly arched shape shown in FIGS. 18 and 19.

Figure 20:
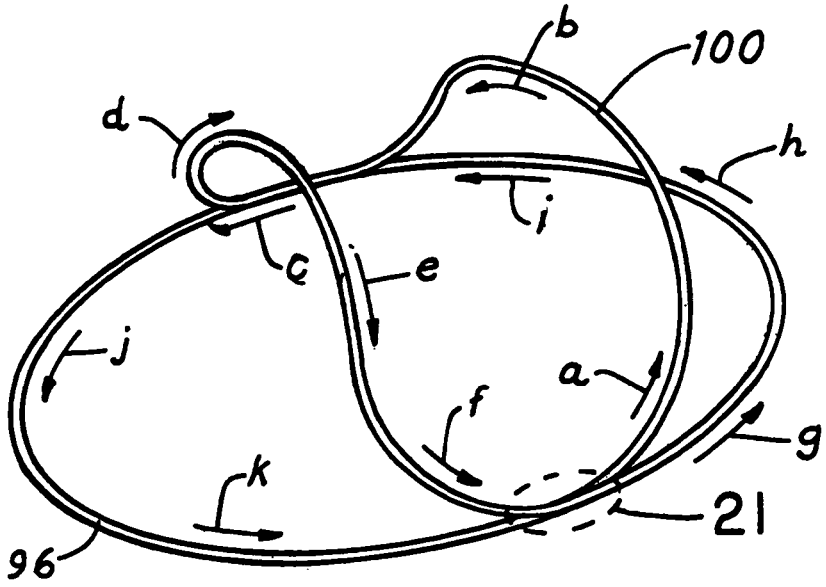
FIG. 20 is a view of a hoop employed in the bed-tent of FIGS. 18 and 19.
Figure 21:
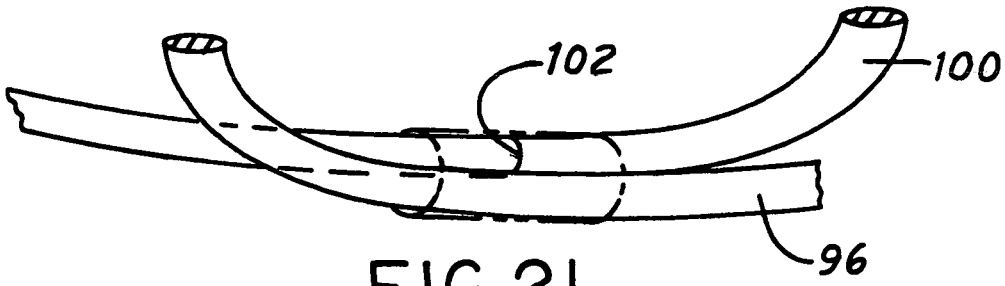
FIG. 21 is an enlarged fragmentary detail of a portion of the hoop indicated at 21 in FIG. 20.

The hoops 96 and 100 may be separately formed or they may, as here shown, be formed from one continuous length of strip material. Thus, referring to FIGS. 20 and 21, and starting at the split 102, the strip material extends up and then down into a rear end portion of the hoop 100 indicated by the arrows a and b, then along the side and front of the hoop 100 as indicated by the arrows c and d, proceeding downward as indicated by the arrows e and f where it extends into the rear portion of the base frame 96 indicated by arrows g and h, then around to the front of the base frame as indicated by the arrow J. The strip material returns to the split 102 at one side of the base frame indicated by the letter k. Thus, one strip of continuous material forms both hoops. Obviously, separate lengths of strip material may be provided if desired to make the separate hoops.

Figure 22:
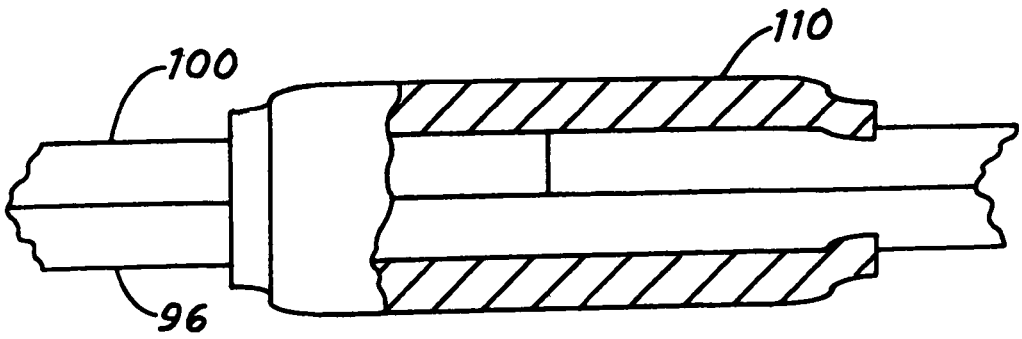
FIG. 22 is a further enlargement showing the coupling between the ends of the hoop.

The split ends of the strip material are secured together by a coupling 110 shown in FIG. 22 which preferably embraces both hoops at one side of the tent. The coupling 110 may allow the ends of the strip material to rotate with respect to each other. The two hoops at the opposite side of the tent may be secured together by any suitable means such as a similar coupling.

A sheet 112 of substantially non-stretchable fabric fills the space within the hoop 100 and is secured to hoop 100 as by a folded-over stitched margin 114 of the sheet. The arched frame 94 including the hoop 100 and the fabric sheet 112 forms the top and sides of the tent.

The front of the tent is completed by a fabric sheet 115 of non-stretchable fabric secured to the stitching along the margin of the fabric sheet 112 forming part of the arched frame 94 and also having a stitched margin to which the front and side portions of the base frame 92 is secured. A similar fabric sheet of non-stretchable fabric 116 is stitched in a similar manner both to the base frame 92 and to the arched frame 94 to complete the canopy enclosure.

FIG. 19 shows the bed-tent 90 secured to the corners 120 of the rectangular mattress 98 by straps 124 as of elastic or the like secured to the edges of the fabric sheets 115 and 116. The bed-tent preferably extends over substantially the entire top surface 99 of the mattress. A flap 128 of fabric material secured to the side edges of the sheets 115 and 116 at one side of the bed-tent may be adapted to be tucked between the mattress 98 and box-spring 130 supporting the mattress. A similar flap (not shown) may be provided on the opposite side of the bed-tent. The flaps may be releasably attached to each other under the mattress. The sheet 112 has a cut-away portion providing a panel 132 which may be folded back for access to the interior of the bed-tent.

Figure 44:
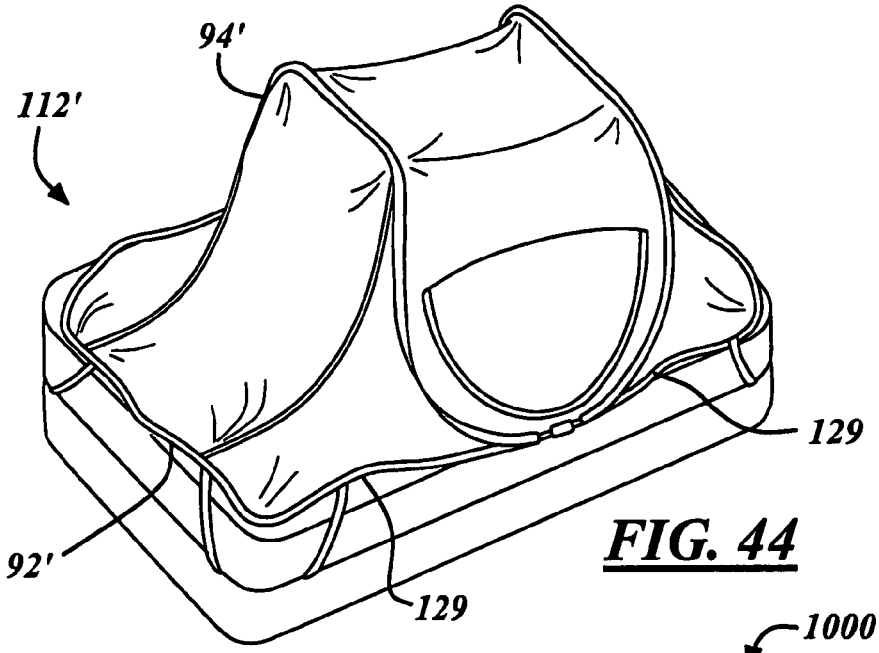
FIG. 44 is a perspective view of a modified bed-tent.

As shown in FIG. 44, a modified bed-tent 112' which is generally similar to the bed-tent 112 shown in FIG. 19, may be provided wherein the resilient strip material of bed-tent 112' may be pre-formed, for example by bending, to correspond more closely to the rectangular shape of the mattress. Base frame 92' may be bent in a generally right-angle configuration at the corners of the mattress, to provide for increased internal living space. Base frame 92' can be additionally bent at one or more midpoints 129 along the length of the mattress to provide a force tending to reduce or eliminate the tendency for the tent to expand outwardly and shift or move off the mattress. These bends may make it possible to eliminate the fabric flap 128, which functions to keep the base member from expanding over the sides of the mattress. Upwardly arched frame 94' may be bent in a similar manner to provide for an approximately flat roof; this provides additional "headroom" and assists in keeping the base member from expanding as mentioned. During folding of the bed-tent, the upwardly arched frame 94' and base frame 92' are placed upon each other before collapsing as usual.

Figure 23:
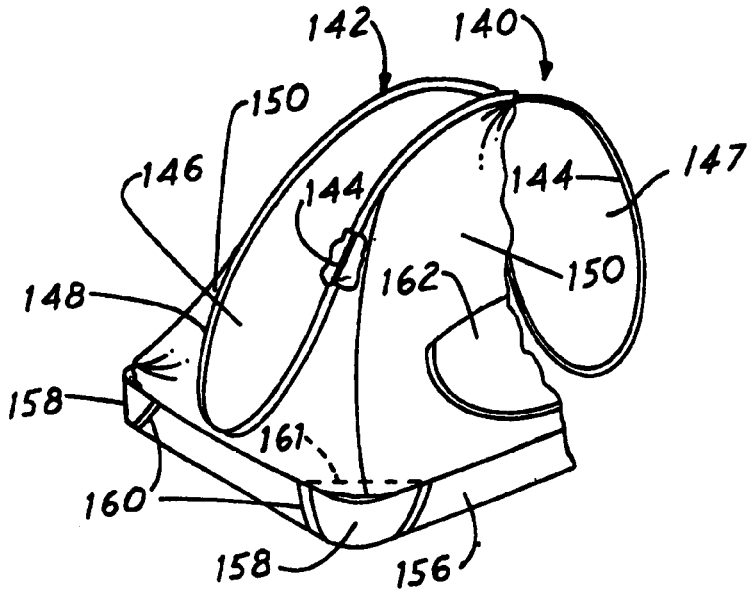
FIG. 23 is a perspective view of a bed-tent according to further modification.
Figure 24:
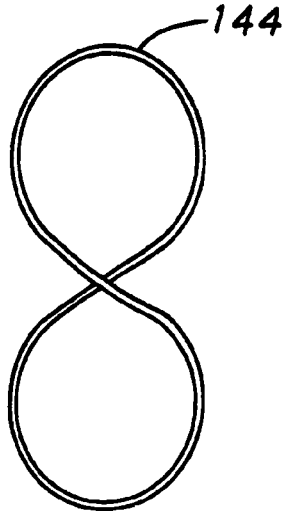
FIG. 24 is a top view of the twisted hoop employed in the embodiment of FIG. 23.

FIG. 23 is a perspective view of a bed-tent 140 of a further modification. The bed-tent 140 has a canopy frame 142 in the form of an endless hoop 144 of the same material as previously described. The hoop 144 is twisted into the shape of the numeral 8 (FIG. 24) and is bent from a naturally flat condition to an upwardly arched shape as shown. Sheets 146 and 147 of substantially non-stretchable fabric fill the space within the twisted loops of the hoop 144 and are secured to the hoop 144 as by folded-over stitched margins 148 of the sheets. The arched frame 142 including the hoop 144 and fabric sheets 146 and 147 form the front, top and rear of the tent.

Sheets 150 of substantially non-stretchable fabric at the front, sides and rear of the tent extend downwardly from the arched frame to the bottom of the tent, being secured as by stitching to the marginal edge portions of the sheets 146 and 147 of the arched frame. The lower edges of the canopy sheets 150 are adapted to extend down to the upper surface of a rectangular mattress 156 and may be held in place along the sides by flaps 154 secured to the side portions of the sheet and adapted to be tucked under the mattress 156 between the mattress and a supporting box spring (not shown).

The bed-tent 140 is secured to the corners 158 of the rectangular mattress 156 by straps 160 secured to the corner portions of the fabric sheets. The bed-tent preferably extends over substantially the entire top surface of the mattress. The four corners of the bed-tent preferably have pads 161 secured to the lower edges of the sheets 150. These pads 161 are like the pads 41 previously described and serve the same purpose. If the bed-tent 140 is smaller than substantially the entire top surface of the mattress, straps 160 are lengthened and pads 161 can be eliminated. The sheet on one side of the bed-tent has a cutaway portion providing a panel 162 which may be folded back for access to the interior of the bed-tent.

Figure 25:
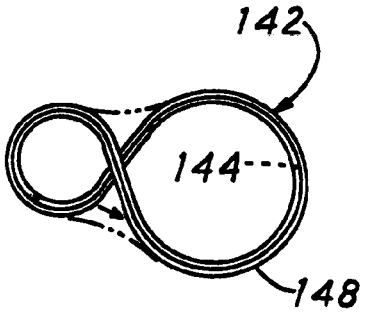
FIG. 25 is a view of the hoop employed in FIG. 23, shown untwisted and within a stitched margin of fabric material, but omitting the fabric material of the bed-tent.
Figure 26:
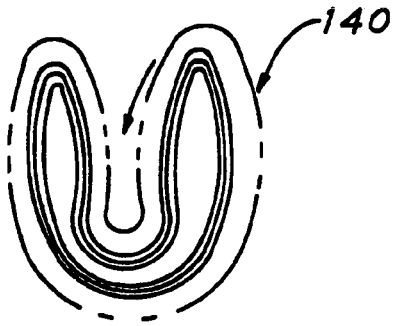
FIGS. 26-28 show the bed-tent of FIG. 23 being folded and finally packaged.
Figure 27:
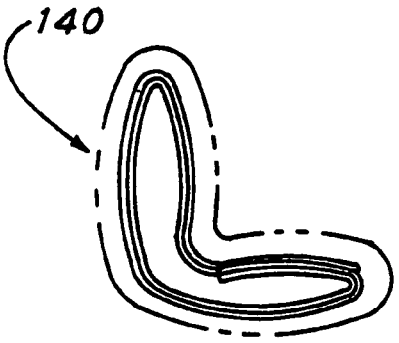
Figure 28:
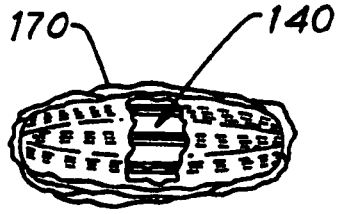

FIG. 25 shows the hoop 144 untwisted, with the fabric excluded. FIGS. 26-27 show a sequence of positions as the bed-tent 140 is folded to a more or less flat condition enabling it to be placed within a package 170 for storage as shown in FIG. 28.

Figure 29:
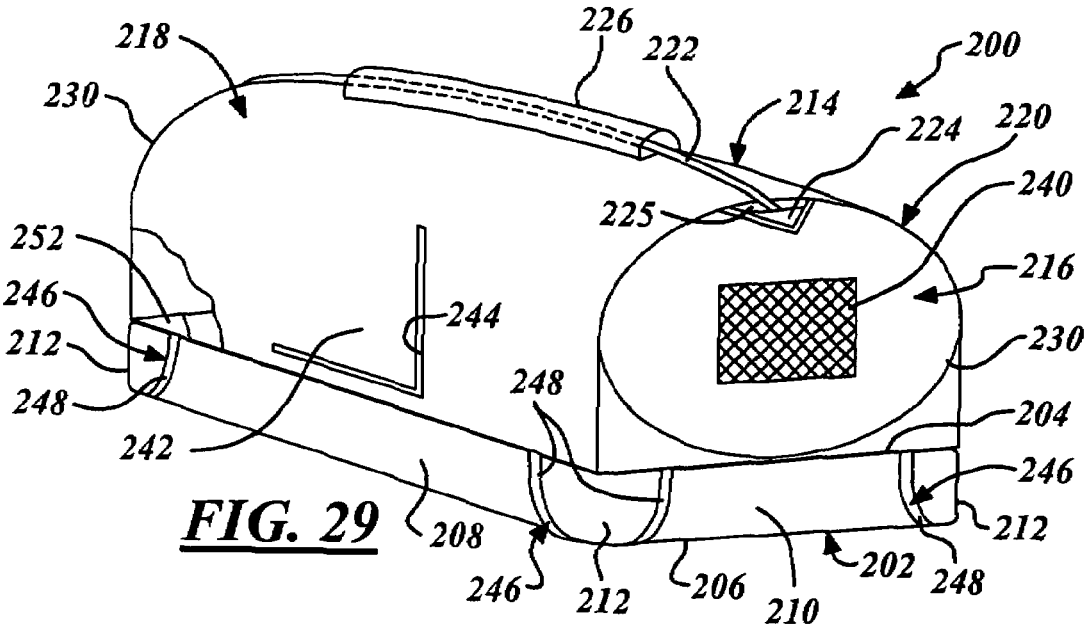
FIG. 29 is a perspective view of one implementation of a bed-tent positioned on a mattress.
Figure 30:
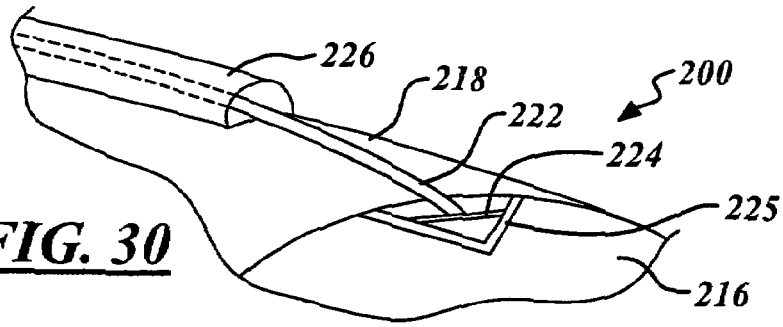
FIG. 30 is an enlarged fragmentary perspective view of a portion of the bed-tent in FIG. 29.

Referring in more detail to the drawings, FIGS. 29 and 30 illustrate another bed-tent 200 that may be secured to a mattress 202 and used as a sleeping shelter or play house. The bed-tent 200 is adapted for use with a mattress 202 that is preferably of the usual rectangular shape having opposed upper and lower surfaces 204, 206, peripheral sidewalls 208 and endwalls 210 extending between the upper and lower surfaces, and four corners 212.

The bed-tent 200 includes a cover 214 and an open base that preferably is generally coextensive with the periphery of the mattress 202. The cover 214 has end panels 216 that may be positioned adjacent to the head and foot of the bed and a flexible fabric canopy portion 218 spanning the end panels 216. The supporting frame 220 holds the end panels 216 in laterally spaced and generally upright position. The frame 220 includes a pole 222 positioned about the exterior of the fabric canopy 218 and extending between at least one pair of pockets 224 each attached to the cover or to the hoop generally adjacent to a separate one of the end panels 216, and through one or more sleeves 226 or loops along the canopy 218 to facilitate maintaining the canopy 218 erect above the mattress 202. Alternately, the pole 222 may be positioned about the interior of the fabric canopy 218. Preferably, each end of the pole 222 is disposed within a separate one of the pockets 224 to maintain the spacing of the end panels 216 from each other. The pockets 224 preferably are disposed in flaps 225 attached to the cover and extending laterally beyond the end panels 216. The pockets may also be attached to fabric canopy 218 so that the pole 222 does not extend laterally beyond the end panels 216. Further, the pole(s) may be releasably attached to the collapsible frame members 230 (not shown). This facilitates holding the canopy 218 in tension so that it is fully expanded for maximum interior tent space. The pole 222 preferably comprises a plurality of elongated, tubular frame segments removeably connected together end-to-end in a linear series providing a generally continuous pole. Each segment of the pole 222 is preferably interconnected by an elastic cord (not shown) under tension. The cord holds together the segments of the pole 222 to facilitate their alignment, and interconnection. The cord also prevents individual segments of the pole 222 from becoming misplaced or lost when not in use.

The frame 220 preferably further includes at least a pair of collapsible frame members 230, one in each end panel 216, such as resilient strips of a flexible material such as spring steel, composite rod or plastic, for example. The hoops 230 may be generally circular, oval, may incorporate one generally square corner, two square corners, may be triangular, approximately square or rectangular; the corners of the various versions may be curved, truncated or generally form right angles. Each hoop frame member 230 may be a continuous annulus or it may be transversely split annulus with abutting ends at the split or open ended. The hoop frame members 230 are preferably disposed in the plane of the end panels 216 and are secured to the outer edge of the panels 216 such as by folding the outer edge of each panel over the hoop 230 and stitching the folded edge to the panel 216. For additional strength, a second hoop of resilient strip material can be secured to the outer edge of the panel. This second hoop can also be formed, with the first hoop, of a single unitary piece. Finally, this second hoop can be adapted to be secured to the first hoop along a limited portion or periphery thereof. The portion of the end panels bounded by each hoop or frame member is held taut by the frame member and resists distortion or collapse of the end panel.

A screened window opening 240 may be provided in the end panels 216, or canopy 218, as desired. The canopy 218 preferably is made of substantially nonstretchable, flexible fabric and extends between the end panels 216. The canopy 218 is held fairly taut by having its ends stitched or otherwise secured to the margins of the end panels 216. So arranged, the canopy 218 defines opposed sides and a top or roof of the tent 200. One side of the canopy 218 preferably has a cutaway portion providing a flap 242 that may be folded back to form an opening 244 for access to the interior of the bed-tent 200. The flap 242 serves as a closure for the opening 244 when extended across the opening and may be releasably held shut by a zipper, Velcro® straps, or other fastening device.

Retainers 246 are preferably disposed at each corner of the bed-tent 200 and are adapted to be secured to or about each corner 212 of the mattress 202. These retainers preferably are flexible straps formed of a relatively elastic and resilient material. The ends of the straps 246 are attached to the fabric of the end panels 216 and/or canopy 218. The strap 246 preferably are U-shaped with 2 legs 248 disposed on and attached to adjacent sides of a corner of the bed-tent 200 with a central bight (not shown) adapted to be disposed around the corner 212 of the mattress 202, preferably with a portion underneath the lower surface 206 of the mattress 202. The straps 246 may be disposed in or covered by a flap of fabric, or they may simply be exposed elastic straps, as shown in FIG. 29

As best shown in FIG. 29, in the interior of the bed-tent 200, optional pads 252 or fabric pieces are preferably stitched or otherwise attached or connected to the end panels and/or cover. These pads 252 overly a portion of the upper surface 204 of the mattress 202, in the area of each of the corners 212 of the mattress 202. When the bed-tent 200 is placed on the mattress 202, the pads 252 rest upon the top surface 204 of the mattress 202 and prevent the bed-tent 200 from being pulled over or down beneath the upper surface 204 of the mattress 202 when the retainers 246 are secured to the mattress 202. The pads 252 may be formed of the same fabric as the canopy 218 and end panels 216, or any other suitable material, as desired. Pads 252 are not necessary if the bed-tent is smaller than the mattress.

The bed-tent 200 is easily erected over the top surface 204 of the mattress 202. This is accomplished by stretching and extending the retainers 246 over the four corners 212 of the mattress 202, and inserting the ridge pole 222 through the sleeve 226 and into the pockets 224. The ridge pole 222 is preferably disposed externally of the canopy 218 which facilitates assembly of the ridge pole 222 to the bed-tent 200.

The tent 200 is just as easily taken off of the mattress 202 and stored. This may be done by removing the ridge pole 222 from the tent, and then removing the retainers 246 from the mattress 202. The segments of the pole 222 may then be disconnected and folded together for convenient storage. The tent 200 may be collapsed and the resilient strip frame members 230 of the end panels 216 are laid over one another and twisted around into a substantially flat coil of reduced diameter so that the entire tent 200 will fit nicely into a very small package for storage. Alternatively, one or more retainers 246 can be wound or wrapped about the flat coil and material of the tent to prevent it from unwinding and expanding, without the need to place the tent within a separate bag or package.

If the resilient strip frame members 230 of the end panels 216 are split rather than continuous, they may be removed from the fabric through an opening provided in the stitching around the panel in which the frame members are received. If the hoop frame member 230 is open ended to form an open arch shaped panel, the ends of the hoop are preferably first placed together before the hoop is twisted in the usual manner.

Figure 31:
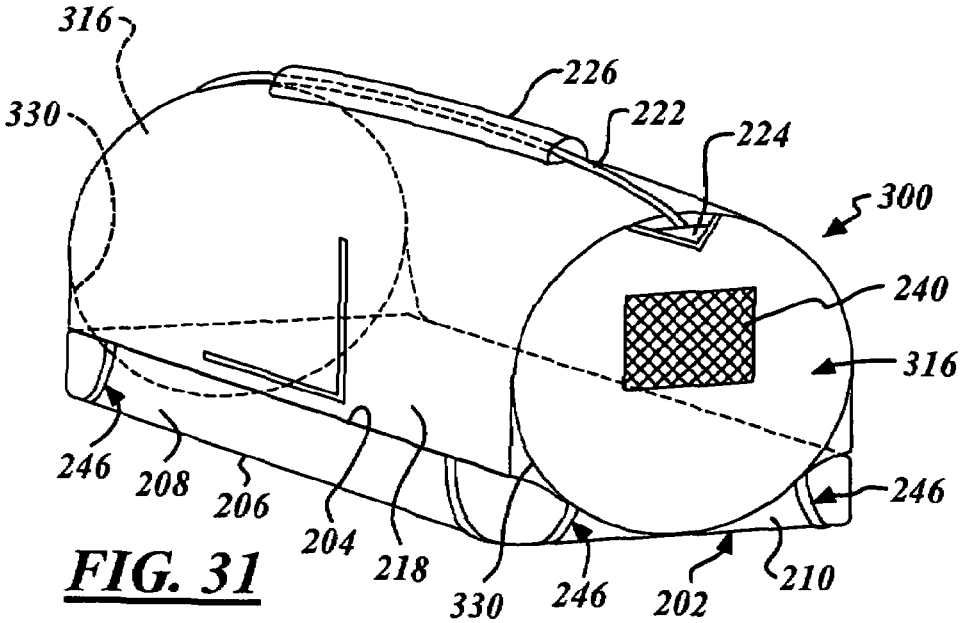
FIG. 31 is a perspective view of an alternate embodiment bed-tent wherein opposed end panels extend beyond an upper surface of a mattress.

A modified bed-tent 300 is shown in FIG. 31. In this embodiment, the end panels 316, preferably including resilient, collapsible frame members 330, extend beneath the top surface 204 of the mattress 202, and may extend along the endwalls 210 of the mattress 202 to the bottom surface 206 of the mattress. They may even extend all the way to the floor. When disposed between the mattress 202 and a headboard and/or footboard of a bed, this may provide additional stability of the tent 300 and prevent lateral movement of the tent 300 off the mattress 22. Otherwise, the bed-tent 300 may be substantially as shown and described with reference to the bed-tent 200 in FIGS. 29 and 30, so similar reference numbers have been applied to at least some of the similar portions of the tent 300 in FIG. 31 and its construction and use will not be further described.

Another implementation of a bed-tent 400 is shown in FIG. 32. In this embodiment, both the canopy 418 and the end panels 416 are extended beneath or below the upper surface 204 of the mattress 202 and may surround the sidewalls 208 and endwalls 210 of the mattress 202. End panel frame members 430 may also extend below the upper surface 204 of the mattress 202. The retainers 246 may be fitted underneath the mattress 202, such as between a box spring 402 and the mattress 202, or the flexible retainers 246 may be replaced with stretchable or substantially nonstretchable flaps or strips of material which are disposed beneath the bottom surface 206 of the mattress 202 to retain the bed-tent 400 in position on the mattress 202. Or, for example, the retainers 246 could be disposed around corners 404 of the box spring 402 with the bight of the retainers underneath the box spring (not shown). Pads 252 may rest on the mattress 202 to help maintain the position of the bed-tent relative to the mattress. If the bed-tent extends to the floor, the retainers 246 can be eliminated and pads 252 may rest on the mattress 252 or between the mattress and box spring 402 or in both locations. Otherwise, the bed-tent 400 may be substantially as shown and described with reference to FIG. 29 so its construction and use will not be further described.

Another implementation of a bed-tent 500 is shown in FIG. 33. This bed-tent 500 includes a roof panel 502 circumscribed by a resilient strip frame member 504 that may be constructed substantially in the same manner as the frame members 430 of the respective end panels 416 of the tent 400. The fabric covering the roof panel frame member 504 may be integral with the remaining fabric of the cover that defines the sides of the bed-tent 500, or the material may be separately formed from the sides of the tent. The ridge pole may not be necessary in this embodiment as the roof panel 502 provides sufficient support to maintain the bed-tent 500 upright and to prevent collapse of the cover toward the mattress 202. The roof panel 502 may be releasably connected immediately adjacent to or in the area of the end panels 416 at each end of the roof panel 502, to provide increased stability of the bed-tent 500. The roof panel 502 preferably is foldable into a coil of reduced diameter or size in the same manner as generally set forth with respect to the end panel frame members 230. Accordingly, the entire bed-tent 500 is provided in a single unit, without additional or loose parts and may be readily collapsed and stored, and expanded and positioned on a mattress 202 as desired. The remainder of the bed-tent 500 may be substantially as described with reference to the bed-tent 200 shown in FIGS. 29, 31 and 32, so its construction and use will not be further described. The roof panel 502 may also be substituted for panels with two frame members as described, for example without limitation, with reference to side panel 606' of FIG. 36 or side panels 902, 904 of FIG. 40, described hereinafter.

Figure 34:
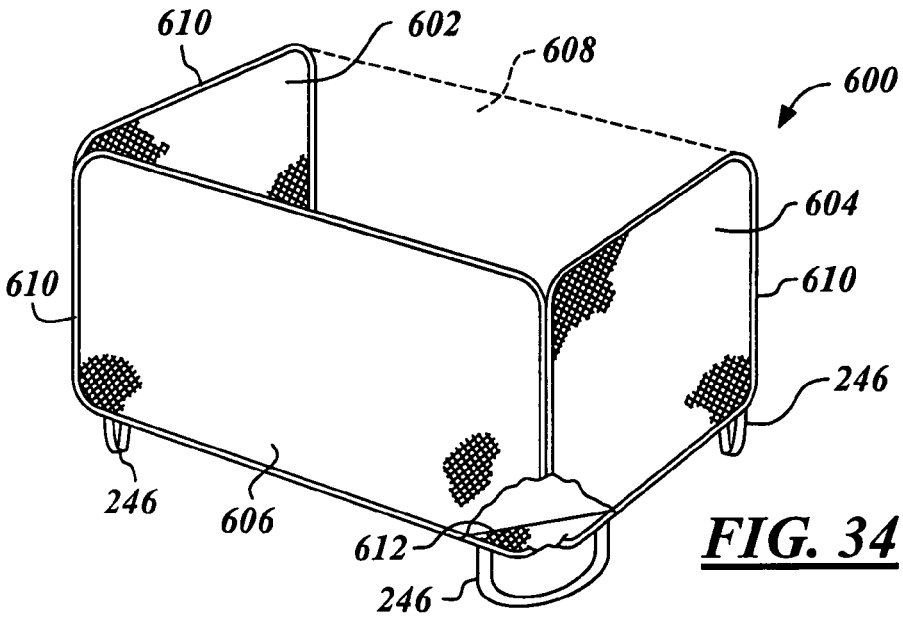
FIG. 34 is a perspective view of another implementation of a bed-tent including three generally rectangular and collapsible panels.

Another modified bed-tent 600 or structure is shown in FIG. 34. In this implementation, the bed-tent 600 includes a plurality of interconnected panels 602, 604, 606 defining a partial enclosure and including one or more retainers 246 adapted to releasably retain the bed-tent 600 on to a mattress 200, bed frame or other structure. In the embodiment shown, the end panels 602, 604 are generally square with rounded corners, and a side panel 606 interconnecting the end panels 602, 604 is generally rectangular with rounded corners. A fabric sheet 608 may be disposed between the end panels 602, 604 providing a roof for the bed-tent and a separate front fabric panel, which includes a door for entry. Each panel 602, 604, 606 preferably includes a flexible resilient strip frame member 610 generally about its periphery and preferably enclosed in material stitched onto itself to retain the resilient strip member 610. The frame members 610 may be folded, collapsed or coiled into generally flat configuration of reduced size or diameter to facilitate storage of the bed-tent. Retainers 246 and/or fabric pieces 612 (which may be the same as or similar to the pads 252 in a prior embodiment) hold the structure to the mattress (not shown) as in FIGS. 30, 31 and 32. If structure 600 is smaller than mattress 202, material 612 can be eliminated.

Figure 35:
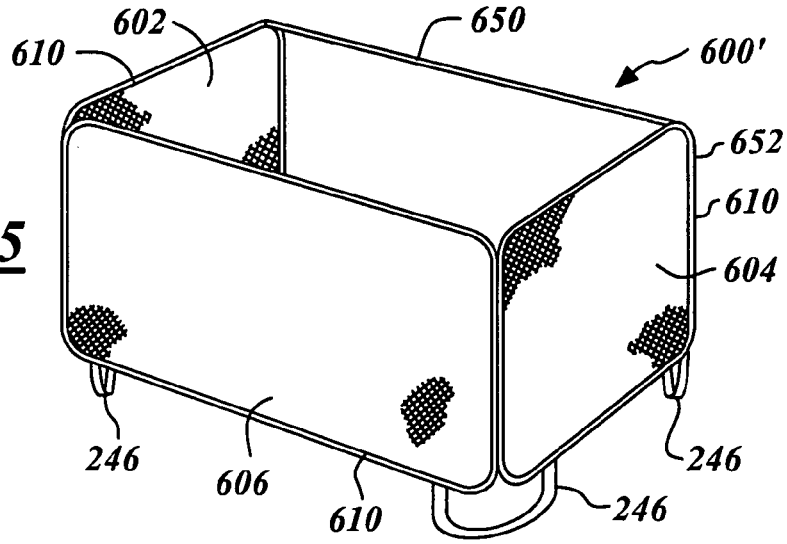
FIG. 35 is a perspective view of another implementation of a bed-tent including three generally rectangular panels and a pole spanning two of the panels.

Another implementation of a bed-tent 600' is shown in FIG. 35. This bed-tent 600' is construction substantially identical to the bed-tent 600 shown in FIG. 34, and includes a pole 650 or connector extending between the end panels 602, 604, generally at an opposite edge 652 of the end panels from the side panel 606. Preferably, the pole 650 extends along an upper corner opposite the side panel 606 and is adapted to receive thereon a sheet or other piece of fabric or cover to facilitate attaching or providing a roof and a front fabric panel for the bed-tent 600'. The pole is attached as described with reference to FIG. 29. The pole may optionally or also be used to hang or attach other accessories for the bed-tent 600', as desired. At least one additional releasable pole may attach to the side and or end panels to provide additional functions, for example, a peaked roof, eaves, vestibules, etc. The remainder of the bed-tent 600' may be constructed substantially as shown and described with reference to the bed-tent 600 in FIG. 34, and hence its construction and use will not be further described.

Figure 36:
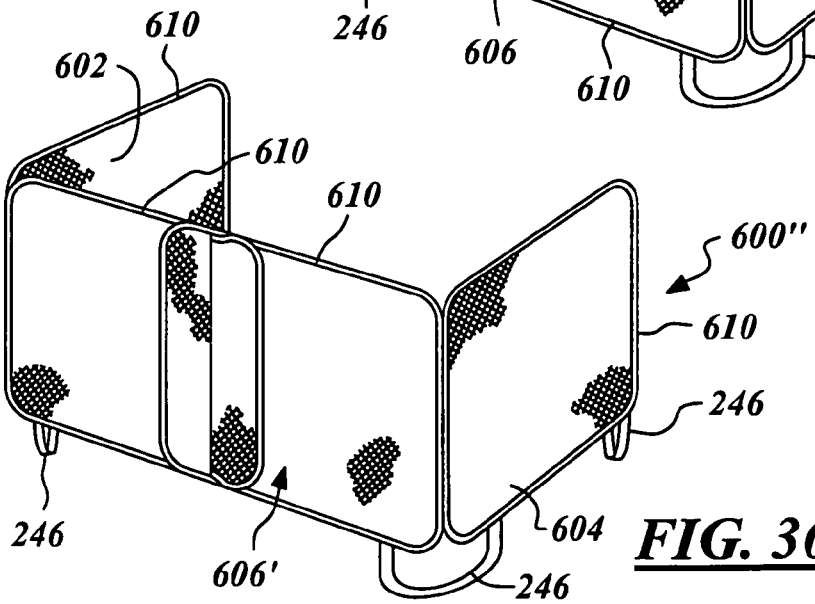
FIG. 36 is a perspective view of a modified bed-tent including three generally rectangular sides with at least one of the sides formed from a pair of generally rectangular and overlapped panels.

The bed-tent 600" shown in FIG. 36 is similar to the bed-tent 600 of FIG. 34. However, the side panel 606' of the bed-tent 600" includes a pair of resilient strip frame members 610 that are at least partially overlapped in a generally common plane and are interconnected to form the side panel 606'. Each of the pair of frame members 610 may be generally square with rounded corners, as the frame members 610 used in the end panels 602, 604. These panels of the sidewall 606 may be connected edge to edge or may be overlapped in the same plane, as shown in FIG. 36. Accordingly, four generally identical panels can be used to form the two end panels 602, 604 and the elongated side panel 606'. Otherwise, the bed-tent 600" may be constructed and used in substantially the same manner as set forth with regard to the bed-tent 600 of FIG. 34 and/or 600' of FIG. 35, so it will not be further described.

Figures 37, 38, 39:
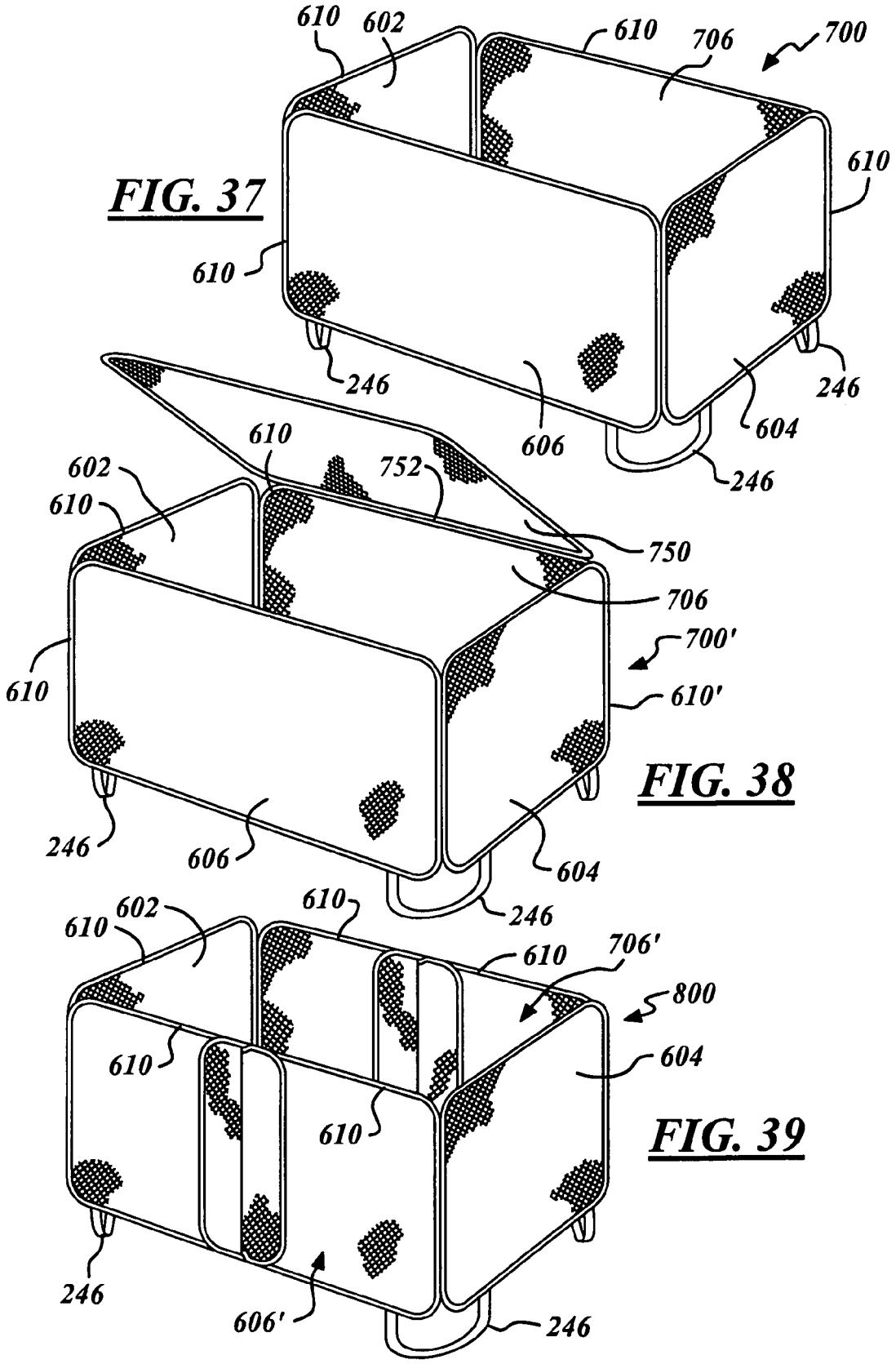
FIG. 37 is a perspective view of a modified bed-tent including four generally rectangular panels.
FIG. 38 is a perspective view of a modified bed-tent including four generally rectangular side panels and a generally rectangular roof panel.
FIG. 39 is a perspective view of a modified bed-tent including four generally rectangular sides with one or more sides being defined by overlapped panels.

The bed-tent 700 of FIG. 37 is similar to the bed-tent 600 shown in FIG. 34 and includes a second elongated side panel 706 opposed to the first side panel 606 and spanning the distance between the end panels 602, 604. The side panel 706 may include a single resilient frame member 610 or may include overlapped frame members 610, as the sidewall 606' in the bed-tent 600" of FIG. 36. A roof, cover or other canopy type arrangement may be provided on the bed-tent 700 as set forth with regard to the previous bed-tents. Otherwise, the bed-tent 700 may be constructed and used substantially as described with reference to the tent 600 shown in FIGS. 34 and 600' as shown in FIG. 35, with at least one optional pole releasably attached to provide eaves, vestibules, etc. and hence, will not be described further.

The bed-tent 700' shown in FIG. 38 is similar to the bed-tent 700 shown in FIG. 37 and includes a top or roof panel 750 releasably connected to one or more of the side and/or end panels 602, 604, 606, 706 of the bed-tent 700. As shown, the roof panel 750 may be constructed substantially identical to the side panels 606, 706 of the bed-tent 700'. The roof panel 750 is shown as been releasably connected along its longer side to the length of the upper edge 752 of a side panel 706 so that the roof panel 752 may be pivoted or folded along its connected edge. The roof panel 752 may be formed with one continuous frame member 610, or may include more than one overlapped or interconnected frame members 610, as desired. Otherwise the bed-tent 700' may be constructed and used substantially as described with reference to the tent shown in FIG. 34.

The bed-tent 800 shown in FIG. 39 is similar to the bed-tent 600" shown in FIG. 37 and has opposed side panels 606', 706' each formed from a pair of interconnected and overlapped panels to define the generally rectangular sides of the bed-tent 800. Each of the overlapped panels forming a sidewall may be substantially identical in size and shape to the panels of the endwalls 602, 604 so that the bed-tent 800 is formed from six equally sized and shaped panels to facilitate its folding and packing. The panels of the sidewalls 606', 706' may be connected edge to edge, or may be overlapped in the same plane, as shown in FIG. 39. A roof panel 752 may be added as in FIG. 38. Alternately, at least one releasably connected pole may be added as described in FIG. 35. Otherwise, the bed-tent 800 may be constructed and used in substantially the same manner as the bed-tent 600" of FIG. 37 and so it will not be described further.

Figure 40:
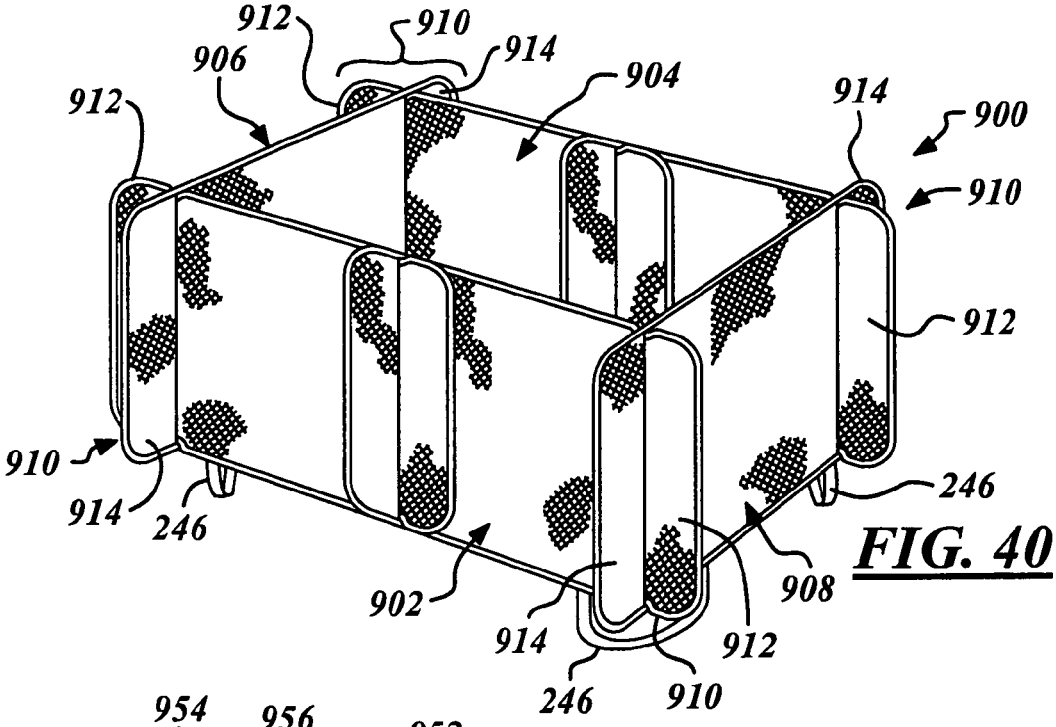
FIG. 40 is a perspective view of a modified bed-tent including four generally rectangular sides defined by panels that may overlap in a common plane and in perpendicular planes at the corners of the bed-tent.

The bed-tent 900 of FIG. 40 is similar to the bed-tent 800 of FIG. 39 except that its side panels 902, 904 and end panels 906, 908 are overlapped and provide outwardly extending corner portions 910 extending at right angles to each other. In other words, an end portion 912 at each end of each side panel 902, 904 intersects and extends beyond the plane of each of the end panels 906, 908, and an end portion 914 at each end of each side panel intersects and extends beyond the plane of each of the side panels. The interior of the bed-tent 900 remains a generally rectangular cube, while the exterior includes the outwardly extending corner portions 910. Otherwise, the construction and use of the bed-tent 900 may be substantially as described with reference to the bed-tent 800 of FIG. 39 so it will not be described further. The panels 902 and 904 could be connected together edge-to-edge as described, for example, with reference to FIG. 36.

Figure 41:
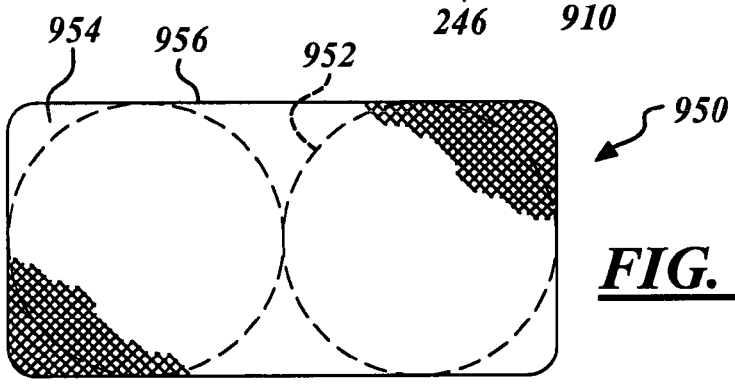
FIG. 41 is a plan view of a panel for a bed-tent having a generally rectangular shape and being supported by a "figure 8"-shaped resilient strip.

An alternate embodiment of a panel 950 for a bed-tent is shown in FIG. 41. The panel 950 includes a "figure 8" shaped frame member 952 which preferably is formed of a resilient strip material as set forth with regard to the prior embodiment bed-tents. The resilient strip frame member 952 is preferably disposed within the boundary or margin of a sheet 954 of flexible material to which the frame member 952 is connected. The "figure 8" shaped frame member 952 may be continuous or split in one or more pieces, and it is preferably disposed within channels, passages, loops or sleeves attached as by stitching to the sheet 954 of the panel. Such a panel 950 may be used as any of the side, end or roof panels, for example, of any of the bed-tents described herein. It may also bend in an approximately right angle to form at least part of one side panel and of one end panel.

Figure 42:
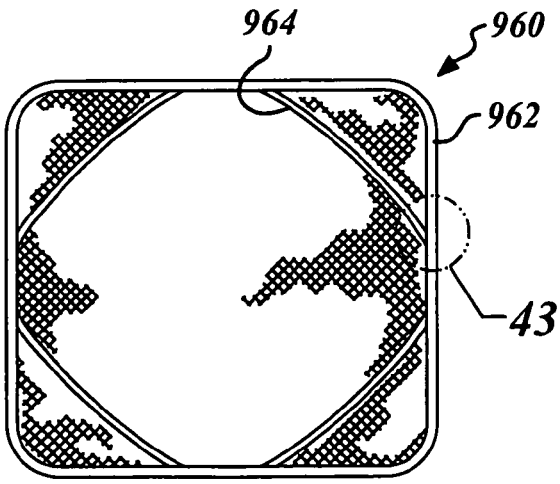
FIG. 42 is an end view of a panel including a supporting frame comprising an inner resilient strip and an outer resilient strip.
Figure 43:
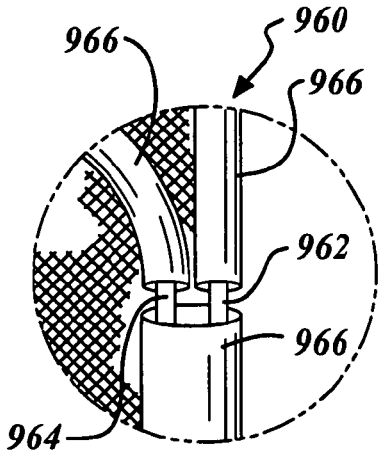
FIG. 43 is an enlarged fragmentary view of the encircled portion 15 in FIG. 42.

An alternate embodiment panel 960 is shown in FIGS. 42 and 43. This panel 960 includes a peripheral frame member 962 which may be continuous or split, and an inner frame member 964 having at least some portion disposed inwardly of the outer frame member 962. The frame members 962, 964 may be disposed within channels, passages, loops or sleeves 966 formed in or attached to the sheet fabric of the panel, such as by sewing. The inner frame member 962 may be disposed within separate sleeves 966 bridging corners of the panel 960 and, as best shown in FIG. 43, the inner frame member 964 may be disposed in the same sleeve 966 as the outer frame member 962 along a portion of the run of the inner frame member 964. In the embodiment shown in FIG. 42, the inner frame member 964 forms a rotated square, or diamond pattern disposed in and joined with or intersecting a generally square outer frame member 962. Of course, substantially any other shape and arrangement can be utilized, as desired for a particular application.

Figure 45:
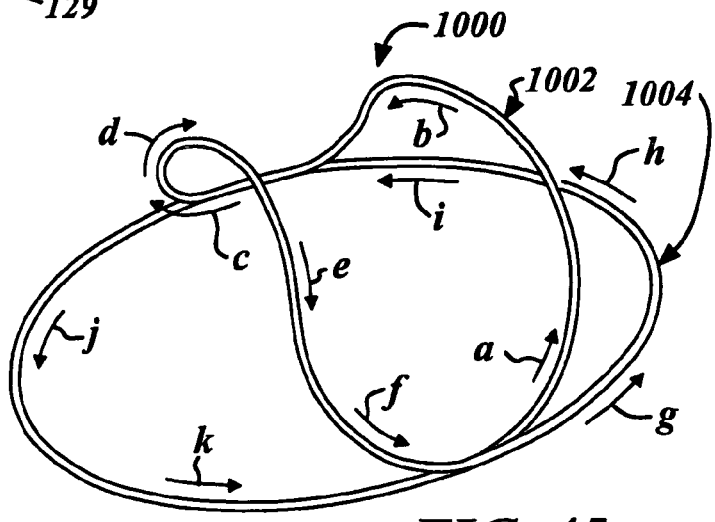
FIG. 45 is a perspective view of a bed-tent frame structure.
Figure 46:
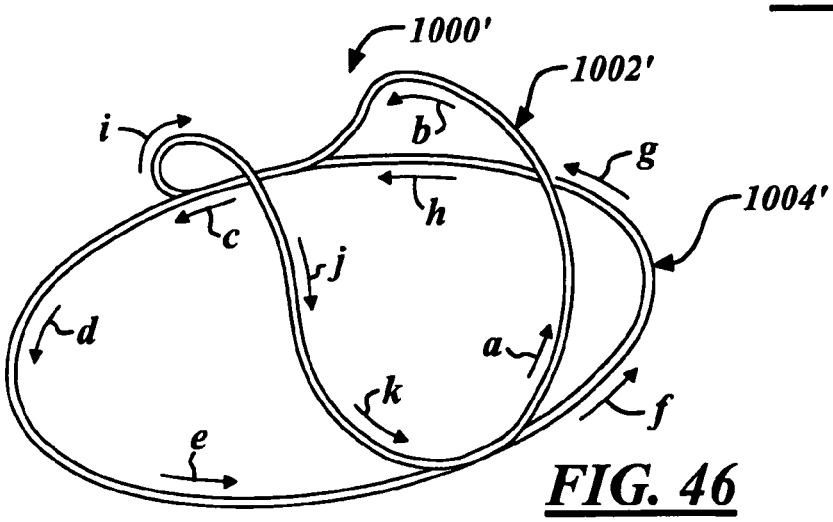
FIG. 46 is a perspective view of a modified bed-tent frame structure formed differently from the frame structure of FIG. 45.

Two similar bed-tent frame members 1000 and 1000' are shown in FIGS. 45 and 46. The frame members 1000 and 1000' preferably are formed from a single strip of resilient material that is bent, or urged by its connection to the fabric of the tent, into the configuration shown. In FIG. 45, the frame member 1000 includes a saddle shaped portion 1002 and an oval portion 1004 that overlies a mattress (not shown). The saddle shaped portion 1002 includes an upwardly curved section 'a' which contains one end 1006 of the strip material of the frame structure 1000. Section 'a' leads to downwardly curved section 'b', which leads to laterally extending section 'c', which leads to upwardly curved section 'd', which leads to downwardly curved section 'e' which leads to laterally extending section 'f'. Section 'f' passes by the end of the strip material and extends laterally along the mattress to section 'g' forms part of the oval section along with sections 'h', 'i', 'j', and 'k'.

The frame member 1000' shown in FIG. 46 is similar to that shown in FIG. 45 in that it also may be formed from a single strip of resilient material having a saddle portion 1002' and an oval portion 1004'. In this embodiment, however, the strip material is routed differently. The saddle sections 'a', 'b', and 'c' lead to oval sections 'd', 'e', 'f', 'g', and 'h'. Oval section 'h' in turn leads to another portion of the saddle section defined by sections 'i', 'j' and 'k', as shown.

Figure 47:
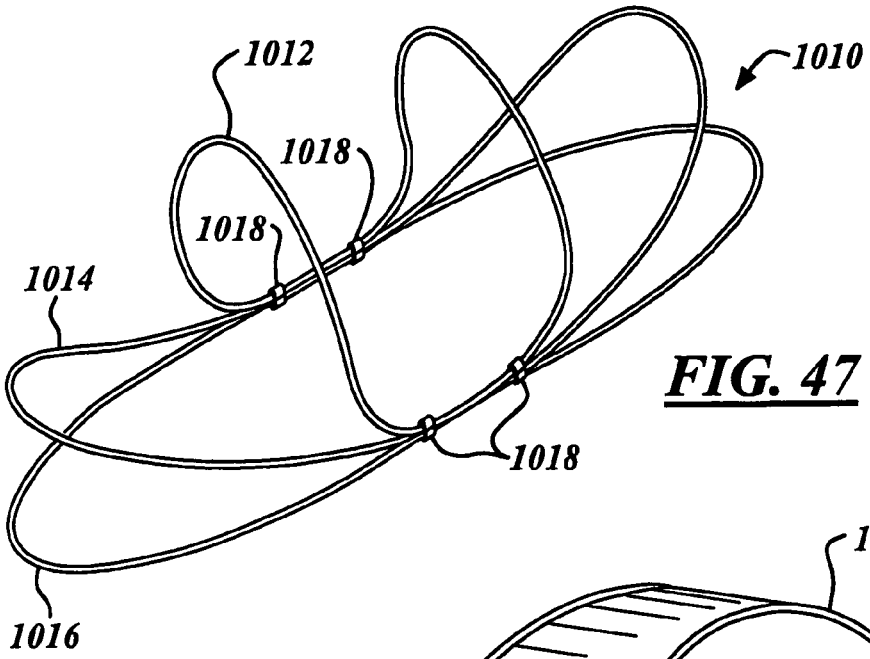
FIG. 47 is a perspective view of a modified bed-tent frame structure comprising multiple frame members.

FIG. 47 illustrates yet another frame member 1010 suitable for use with a bed-tent. The frame member 1010 preferably is formed from one or more strips of resilient material that is bent, or urged by its connection to the fabric of the tent, into the configuration shown. The frame member 1010 includes a central saddle section 1012, a slightly concave middle oval section 1014, and a lower oval section 1016 adapted to overlie a mattress. Connectors 1018 preferably interconnect the adjacent runs of the sections 1012, 1014, 1016 and permit rotation or pivoting the sections relative to one another to facilitate folding flat and collapsing a bed-tent with which the frame structure 1010 is used. The connectors 1018 prevent outward bowing or movement of the various sections to facilitate maintaining a bed-tent on a mattress. The frame member 1010 may be formed in substantially the same manner as, for example, the frame member 1000 of FIG. 45 except that the frame member 1010 includes two oval sections as shown.

Figure 48:
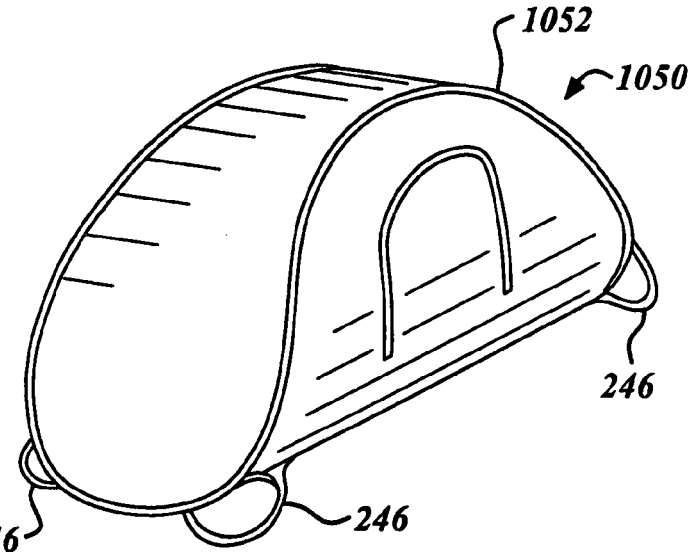
FIG. 48 is a perspective view of a modified bed-tent.

FIG. 48 illustrates a bed-tent 1050 formed from an upwardly bowed frame member 1052 disposed in the shape of an inverted saddle. The frame member 1052 preferably is formed from a single strip of resilient material that is bent, or urged by its connection to the fabric of the tent, into the configuration shown. The frame member 1052 may be circumferentially continuous, or it may be split. The bowed frame member 1052 keeps the fabric of the bend tent 1050 in tension when erected. Retainers 246 may also help keep the bed-tent stretched out over the mattress in a manner already described, such as by engaging one or more of the four corners of the mattress.

Figure 49:
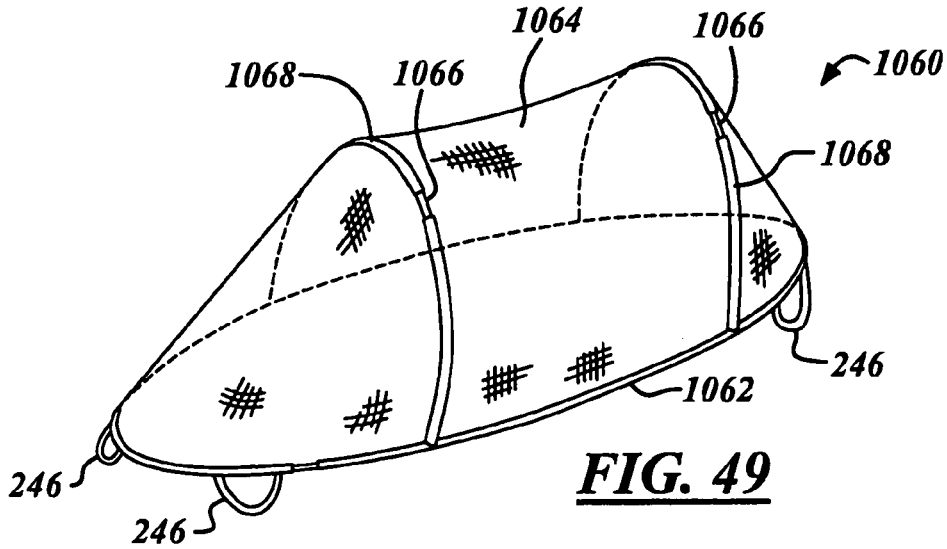
FIG. 49 is a perspective view of a modified bed-tent.

FIG. 49 illustrates a bed-tent 1060 that utilizes a single continuous resilient strip frame member 1062 that forms the base of the structure. The base may be formed in any desired shape such as oval (as shown), rectangular, square, etc. A fabric canopy 1064 is supported by one or more open-ended resilient strips 1066 formed into an arch shape by a fabric channel 1068 affixed to the base by stitching or the like. A pivoting junction, affixed to the base loop is a further attachment, by way of example without limitation. To collapse the structure, at least one open-ended resilient strip is detached from the canopy, allowing both open-ended strips to lie atop the base 1062. The structure is collapsed by folding as usual. Both the base 1062 and the open-ended strip(s) 1066 can be bent, as previously described, to better conform to the rectangular shape of the mattress. Retainers 246 may also help keep the bed-tent 1060 stretched out over the mattress in a manner already described, such as by engaging one or more of the four corners of the mattress.

One of ordinary skill in this art will readily recognize that the preceding description has been set forth in terms of description rather than limitation. While many of the panels of the bed-tents disclosed herein have been shown as being circular, oval, square or rectangular, the panels and any desired portion of the bed-tents may be formed in any desired shape. The panels of the various embodiments may be releasably attached to allow the separate panels to be easily folded for storage. The pads, which maintain the bed-tent on top of the mattress, may be eliminated if the structure is 2-4 inches smaller than the mattress. Further, while the bed-tents disclosed herein have been shown with an open base so that immediate access can be provided to the sheets, blankets or other linens on the bed with which the tent is used, a base panel may be provided if desired. Still further, while the frame members have been described as being retained in or on the panels of the bed-tent by stitching or the fabric around the frame members, they may be otherwise connected. For example, adhesive, or hook and loop type fasteners, may be employed to name a couple of many possibilities. Still other modifications and substitutions can be made without departing from the spirit and broad scope of this invention. The invention is to be defined by the following claims.

The invention claimed is:

1. A bed-tent, comprising:

at least three generally planar and interconnected walls having a lower edge adapted to overlie a mattress on which the bed-tent is erected and an upper edge spaced from the lower edge and the mattress, the walls define an interior space between them, and each wall has a fabric panel and a resilient strip frame member connected to the fabric panel to maintain the fabric panel generally taut and upright when the bed-tent is erected, with each frame member being capable of being twisted or wound into a relatively flat coil of reduced diameter; and at least one retainer carried by at least one of said walls and adapted to engage a portion of a mattress on which the bed-tent is erected with a portion of said at least one retainer received underneath the mattress.

2. The bed-tent of claim 1 wherein the walls define a sidewall and end walls that are connected at opposite ends of the sidewall and are disposed at an angle relative to the sidewall.

3. The bed-tent of claim 2 wherein the end walls are disposed parallel to each other when the bed-tent is erected, and at right angles to the side wall.

4. The bed-tent of claim 1 wherein the at least one retainer is adapted to engage a corner of a mattress on which the bed-tent is erected.

5. The bed-tent of claim 2 which also includes a connector spaced from the sidewall and having opposed ends connected to the end panels.

6. The bed-tent of claim 2 wherein the end walls and sidewall are generally rectilinear.

7. The bed-tent of claim 6 wherein the end walls and sidewall are generally rectangular.

8. The bed-tent of claim 7 wherein each frame member is disposed about the periphery of its associated wall.

9. The bed-tent of claim 1 wherein at least one of the walls is defined by a pair of panels with each panel having a fabric panel and a resilient strip frame member that supports the fabric panel, and with each of the pair of panels being interconnected and extending along a generally common plane.

10. The bed-tent of claim 9 wherein the pair of panels have portions that are overlapped.

11. The bed-tent of claim 1 wherein said at least three walls include four generally planar walls that define an open top and open bottom enclosure.

12. The bed-tent of claim 11 wherein each wall is generally rectilinear.

13. The bed-tent of claim 12 wherein each wall is generally rectangular.

14. The bed-tent of claim 1 wherein said at least three walls include five generally planar walls that define an open bottom enclosure with said open bottom adapted to be disposed adjacent to a mattress on which the bed-tent is erected.

15. The bed-tent of claim 1 which also comprises a roof panel connected to at least one of said at least three walls and extending between each of said at least three walls at a location above a mattress on which the bed-tent is erected to define a roof of the bed-tent.

16. The bed-tent of claim 11 wherein at least one of the walls is defined by a pair of panels with each panel having a fabric panel and a resilient strip frame member that supports the fabric panel, and with each of the pair of panels being interconnected and extending along a generally common plane.

17. The bed-tent of claim 11 wherein at least two of the walls are defined by a pair of panels with each panel having a fabric panel and a resilient strip frame member that supports the fabric panel, and with each of the pair of panels being interconnected and extending along a generally common plane.

18. The bed-tent of claim 2 wherein the side wall intersects at least one of the end walls providing an outwardly extending corner portion.

19. The bed-tent of claim 18 wherein the side wall and end wall that intersect are disposed at right angles to each other.

20. The bed-tent of claim 18 wherein one of the side wall and end wall includes an opening through which the other of the side wall and end wall extends.

21. The bed-tent of claim 2 wherein the sidewall intersects both end walls providing outwardly extending corner portions at each of the end walls.

22. The bed-tent of claim 1 wherein said at least three walls include four generally planar walls with two parallel side walls and two parallel end walls interconnecting the side walls, and wherein the side walls and end walls intersect providing outwardly extending corner portions at each corner of the bed-tent.

23. The bed-tent of claim 22 wherein at each corner, at least one of the side wall or end wall includes an opening through which the other of the side wall and end wall extends.

24. The bed-tent of claim 1 wherein at least one of said walls includes a pair of frame members with a first frame member being disposed about the periphery of the wall and a second frame member being disposed generally within a boundary defined by the first frame member.

25. The bed-tent of claim 24 wherein said second frame member is in the shape of a "figure 8".

26. The bed-tent of claim 24 which also includes sleeves carried by the fabric panel of said wall and wherein said first frame member and said second frame member are each received in a common sleeve alone a portion of the extent of the second frame member.

27. The bed-tent of claim 24 wherein said first frame member and said second frame member are generally rectangular when expanded and the orientation of said second frame member is offset relative to the orientation of the first frame member.

28. The bed-tent of claim 17 wherein the pair of panels have portions that are overlapped.

* * * * *

UNITED STATES PATENT AND TRADEMARK OFFICE

CERTIFICATE OF CORRECTION

PATENT NO. : 7,392,555 B2
APPLICATION NO. : 11/247542
DATED : July 1, 2008
INVENTOR(S) : Thomas C. Danaher It is certified that error appears in the above-identified patent and that said Letters Patent is hereby corrected as shown below:

In the patent, column 15, line 6 after “mattress” delete “22” and insert --202--

In the patent, column 15, line 30 after “mattress” delete “252” and insert --202--

In the patent, column 16, line 1 after “mattress” delete “200” and insert --202--

In the patent, column 16, line 21 after “is” delete “construction” and insert --constructed--

In the patent, column 17, line 7 after “as” delete “been” and insert --being--

In the patent, column 18, line 63 after “the” delete “bend tent” and insert --bed-tent--

In the patent, claim 26, column 21, line 8 after “sleeve” delete “alone” and insert --along--

Signed and Sealed this

Twenty-third Day of September, 2008

JON W. DUDAS
*Director of the United States Patent and Trademark Office*